US009520247B1

(12) United States Patent
Finnegan et al.

(10) Patent No.: US 9,520,247 B1
(45) **Date of Patent: *Dec. 13, 2016**

(54) AUTOMATED OPERATION OF FIXTURES

(71) Applicant: Switchmate Home LLC, Pleasanton, CA (US)

(72) Inventors: Dean Finnegan, Pleasanton, CA (US); Geoff White, Sunnyvale, CA (US); Robert Y. Romano, Stanford, CA (US); Tyler Kroymann, Palo Alto, CA (US); Ashish Dua, S. San Francisco, CA (US); Daniel Peng, Pleasanton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/236,482

(22) Filed: Aug. 15, 2016

Related U.S. Application Data

(63) Continuation-in-part of application No. 14/617,020, filed on Feb. 9, 2015, now Pat. No. 9,418,802.

(60) Provisional application No. 61/937,493, filed on Feb. 8, 2014, provisional application No. 62/065,564, filed on Oct. 17, 2014.

(51) Int. Cl.

| | |
|---|---|
| ***H01H 23/14*** | (2006.01) |
| ***H01H 3/06*** | (2006.01) |
| ***F21V 23/04*** | (2006.01) |
| ***H01H 3/46*** | (2006.01) |
| ***H01R 25/00*** | (2006.01) |

(52) U.S. Cl.
CPC ..... *H01H 3/06* (2013.01); *F21V 23/04* (2013.01); *F21V 23/0435* (2013.01); *H01H 3/46* (2013.01); *H01R 25/006* (2013.01); *H01H 2221/016* (2013.01); *H01H 2231/032* (2013.01)

(58) Field of Classification Search
CPC ..... H01H 23/141; H01H 2221/016; F21V 23/0435; F21V 23/04; H01R 24/76; H01R 13/665; H01R 13/6683
USPC ..... 200/331, 241–242, 333; 174/66–67; 439/536
See application file for complete search history.

(56) References Cited

U.S. PATENT DOCUMENTS

| | | | | |
|---|---|---|---|---|
| 7,214,898 | B1 * | 5/2007 | Margareten | H01H 9/287 174/66 |
| 7,273,983 | B1 * | 9/2007 | Rintz | F21S 8/035 174/66 |
| 8,796,567 | B2 * | 8/2014 | Mahle | G04F 3/025 200/33 R |
| 2009/0020307 | A1 * | 1/2009 | Roach, Jr. | G09F 1/12 174/66 |
| 2015/0244121 | A1 * | 8/2015 | Amelio | H01R 24/78 439/345 |

* cited by examiner

*Primary Examiner* — Edwin A. Leon

(57) ABSTRACT

Control devices for automatically and/or remotely controlling fixtures such as, for example, light fixtures and/or other electrical and/or electronic devices, by controlling, operating, and/or interacting with existing switches, controls, power sources, and/or other components already present in an environment of interest, and methods for their installation and use.

22 Claims, 18 Drawing Sheets

AUTOMATED OPERATION OF FIXTURES

This application is a continuation-in-part of U.S. application Ser. No. 14/617,020, filed Feb. 9, 2015, issuing as U.S. Pat. No. 9,418,802 on Aug. 16, 2016, which claims priority from U.S. Provisional Patent Application No. 61/937,493, filed Feb. 8, 2014, and from U.S. Provisional Patent Application No. 62/065,564, filed Oct. 17, 2014, and claims priority from and benefit of each of the applications enumerated in this paragraph, each of which is incorporated herein by reference in its entirety.

BACKGROUND

The present disclosure relates generally to automation of pre-existing fixtures. Specifically, in illustrative embodiments, there is disclosed a novel design for the instant alignment and installation to an existing fixture and the ability to wirelessly actuate a lever and/or other control on the fixture, and other embodiments relating to automated control of fixtures.

As is known in the art, adding automated or remote control functionality to existing fixtures typically entails either physical replacement, modification, and/or disassembly of all or part of the existing fixture, or bypassing the existing fixture entirely. This creates impediments to consumer adoption because many are unwilling to make changes to electrical connections or want to control lights and other fixtures connected to an existing switch.

SUMMARY

Disclosed herein are embodiments of an automation device intended to allow users to actuate a pre-existing fixture wirelessly and remotely with minimal installation and alignment. Minimal installation and instant alignment may be met, for example, by specific placement of magnets on the backing plate of the device such that they align directly with metallic screws on an existing fixture, and/or by the use of other self-affixing modalities as disclosed herein. Embodiments are provided for pre-existing light switch fixtures having a snap-action toggle-type lever mechanism as well as for light switch fixtures with a flat, broad rocker-type lever mechanism which is relatively flush with the fixture. Embodiments are also provided for light switch fixtures that incorporate both a switch lever and a dimmer, with functionality to operate and/or control either or both. Also provided are embodiments of an automation device incorporating a motion sensor and/or an ambient light sensor, with functionality to take into account movement and/or ambient light levels in the operation and/or control of the light switch or other fixture, and embodiments of an automation device for controlling an electrical receptacle.

In some embodiments adapted for toggle-type switches an automation device operates with a linear actuator comprising a rack and pinion mechanism. This mechanism is used to actuate the lever of the pre-existing light switch fixture that the automation device is installed on. The pinion is attached to the head of a servomechanism, which operates on a control system to control the position of the pinion and ultimately the rack. In some embodiments adapted for rocker-type switches, an automation device operates with a rotational mechanism to actuate the broader, flush lever of the switch. The servomechanism may be selected to provide an adequate amount of torque and range of motion to toggle levers of both types.

In some embodiments, the automation device includes a system to allow for wireless control of the automation device. In embodiments, the system includes a Bluetooth Low Energy (BLE) or other wireless module, allowing for wireless control of the automation device from other devices operating on this protocol. In some embodiments, the automation device includes a microcontroller to communicate with the wireless module to handle logic for timers, proximity detection, schedules, or other smart features.

In some embodiments, the automation device can send data to and from an external wireless gateway device containing Wi-Fi and BLE modules or other wireless modules/protocols, allowing for control and status information of the devices from a remote location. In some embodiments, the wireless gateway is not necessary for the operation of the device, where, for example, the intended application does not require increased range of communication with the automation device. These wireless gateways may include, but are not limited to, personal computers, smart phones, and tablet devices.

In embodiments, an object of the present disclosure is to provide for rapid installation of home automation systems and components without exposing electrical wiring or other components carrying potentially dangerous electrical currents or potentials.

In embodiments, an object of the present disclosure is to provide for installation of home automation systems and components without a need for specialized expertise and/or tools.

In embodiments, an object of the present disclosure is to provide for home automation systems and components within the capabilities of a typical homeowner or consumer to install.

In embodiments, an object of the present disclosure is to provide devices, methods, and systems for home automation systems and components that can be installed rapidly and/or instantly and/or in a single step in their out-of-the-box configuration.

In embodiments, an object of the present disclosure is to provide for installation of home automation systems and components capable of operating controls and/or fixtures already present in the home ecosystem, without modification, removal, or disassembly of the controls and/or fixtures.

In embodiments, an object of the present disclosure is to provide for installation of home automation systems and components capable of operating and/or controlling standard electrical controls and devices, such as, for example, light switches, electrical receptacles, dimmers, motor controls, and environmental controls.

In embodiments, an object of the present disclosure is to provide for installation of home automation devices over existing controls or devices in a manner whereby the home automation devices are maintained in position and/or alignment without the use of screws or other invasive attachment modalities.

In embodiments, an object of the present disclosure is to provide for installation of home automation systems and components in a manner whereby the home automation devices are readily removable without damage and/or alteration to the existing controls or devices to which they are installed, and/or whereby upon such removal the existing controls or devices are substantially restored to their condition prior to the installation without further operation thereon.

It will be apparent to persons of skill in the art that various of the foregoing aspects and/or objects, and various other aspects and/or objects disclosed herein, can be incorporated and/or achieved separately or combined in a single device, method, system, composition, article of manufacture, and/or improvement thereof, thus obtaining the benefit of more than one aspect and/or object, and that an embodiment may encompass none, one, or more than one but less than all of the aspects, objects, or features enumerated in the foregoing summary or otherwise disclosed herein. The disclosure hereof extends to all such combinations. In addition to the illustrative aspects, embodiments, objects, and features described above, further aspects, embodiments, objects, and features will become apparent by reference to the drawing figures and detailed description. Also disclosed herein are various embodiments of related methods, devices, apparatus, compositions, systems, articles of manufacture, and/or improvements thereof. The foregoing summary is intended to provide a brief introduction to the subject matter of this disclosure and does not in any way limit or circumscribe the scope of the invention(s) disclosed herein, which scope is defined by the claims currently appended or as they may be amended, and as interpreted by a skilled artisan in the light of the entire disclosure.

BRIEF DESCRIPTION OF THE FIGURES

FIG. 11 shows the rotational head for an embodiment of an automation device according to the disclosure hereof adapted for a rocker-type switch and the servomechanism it attaches to.

Figures are not to scale unless expressly so labeled, and relative positions of objects and components are illustrative. Persons of skill in the art will recognize that many other arrangements, configurations, dimensions, and selections of components are possible and consistent with the disclosure hereof, and are in no way limited to the embodiments shown in the figures.

DETAILED DESCRIPTION

Disclosed herein are embodiments of novel methods, systems, devices, apparatus, compositions, articles of manufacture, and improvements thereof useful for automatically and/or remotely controlling appliances and/or devices such as, for example, light fixtures and/or other electrical and/or electronic devices, by controlling, operating, and/or interacting with existing switches, controls, power sources, and/or other components already present in the environment of interest.

In general, provided herein are embodiments of automation devices adapted and configured to be installed in engagement with existing user controllable fixtures present in a home, office, or other environment of interest, and to interact with the existing user controllable fixtures so as to operate and/or control them, thereby in turn controlling and/or operating one or more appliances and/or devices that interface with the existing user controllable fixtures. In embodiments, the user controllable fixtures may include any of the many components and/or fixtures commonly found in a home, office, or other environment, such as, for example, light switches, light dimmers, rheostats, electrical receptacles, motor controls, thermostats, heating, cooling, and/or ventilation controls, intrusion, fire and/or other alarm controls, irrigation and/or sprinkler controls, drape, window, and/or shutter controls, door and window locks, and appliance controls.

Figure 1A:
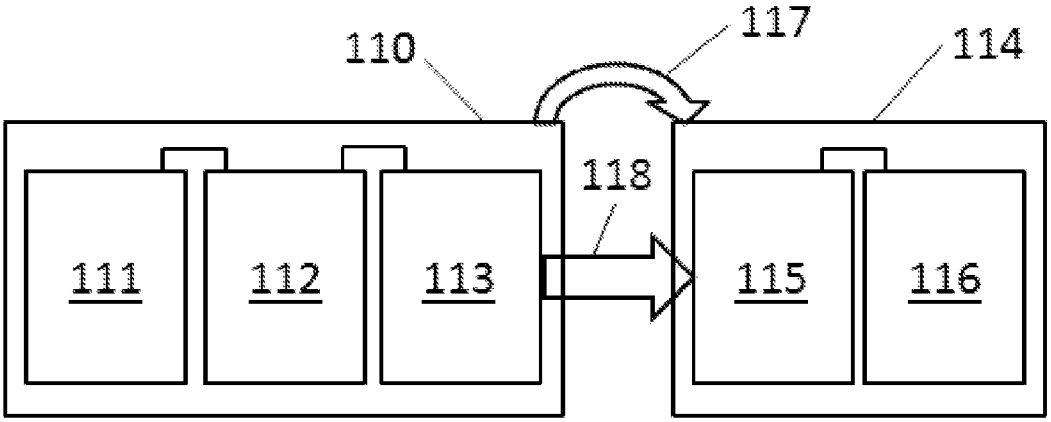
FIG. 1A is a schematic depiction of a generalized example embodiment of an automation device for engagement with a user controllable fixture consistent with the disclosure hereof.

In embodiments, as illustrated schematically in FIG. 1A, in general an automation device 110 for controlling and/or operating a user controllable fixture 114 may include an actuator 113 adapted and configured to engage with 118 and control and/or operate a physically operable control 115 of the user controllable fixture. The actuator may be coupled to and/or under the control of a controller 112, which may be coupled to and/or in communication with an interface 111 from which the controller may receive instructions. The physically operable control of the user controllable fixture may be coupled to and/or control a functional component 116 of the user controllable fixture or of another device or fixture. The automation device may be installed and/or affixed to the user controllable fixture by a self-affixing attachment 117, which may include any attachment modality allowing for installation of an automation device in engagement with a user controllable fixture solely by placing the automation device in position and optionally applying pressure, making minor positional adjustments to the automation device or a part or component thereof, or otherwise securing the automation device in position without need for the use of tools and without modifying, removing, or disassembling the user controllable fixture or any part thereof.

In some embodiments, the automation devices are adapted and configured to be installed in physical engagement with user controllable fixtures already present in the environment of interest, and to control and/or operate the existing user controllable fixtures by physical manipulation thereof. In some embodiments, the automation devices are adapted and configured to interface physically with the existing user controllable fixtures and control and/or operate the existing user controllable fixtures without the necessity of any modification to or disassembly of the latter. In some embodiments, an automation device is provided with one or more user controls for use in controlling and/or operating the automation device and thereby in turn controlling and/or operating an existing user controllable fixture with which the automation device is associated and/or interfaced. In embodiments, user controls may include any of the many components and devices used for controlling electrical, electronic, and/or electromechanical devices, such as, for example, buttons, switches, dials, sliders, touch screens, and keypads, and may be disposed in or on the automation device and/or may operate an automation device remotely such as, for example, in response to one or more signals from a remote control, remote keypad, console, computer, or cellular phone.

Also provided herein are embodiments of automation systems for controlling one or more automation devices. Also provided herein are embodiments of methods of controlling and/or operating automation devices, and methods of controlling and/or operating existing user controllable fixtures by controlling and/or operating automation devices associated and/or interfaced therewith. Also provided herein are embodiments of methods of installing automation devices.

Figure 1B:
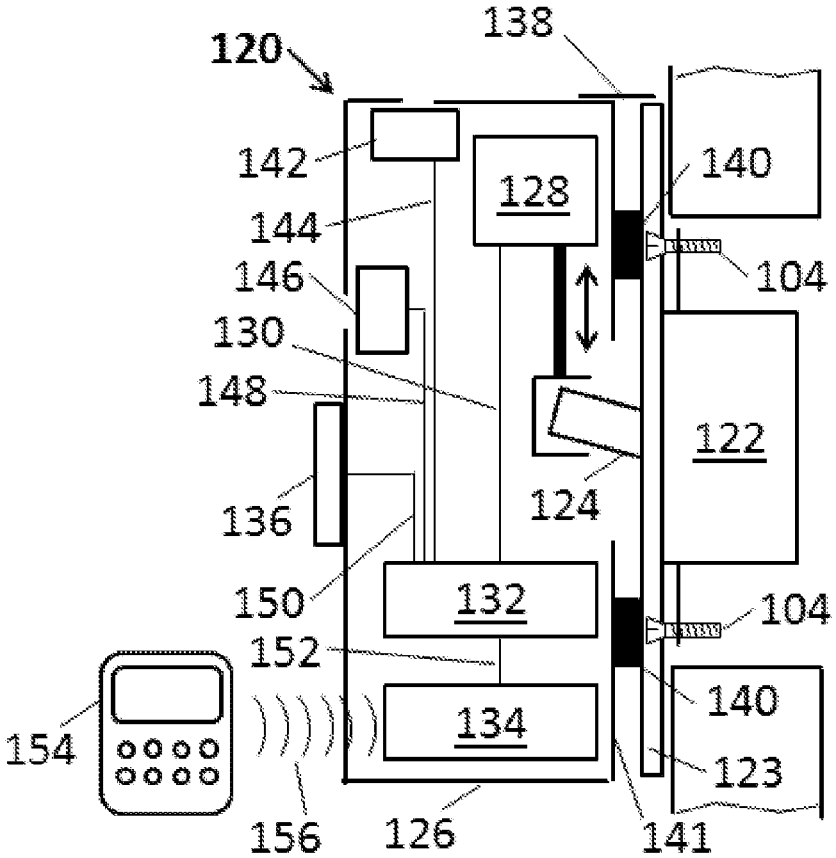
FIG. 1B is a schematic depiction of an embodiment of a switch automation device consistent with the disclosure hereof, in engagement with a toggle-type switch.

In embodiments as depicted schematically in FIG. 1B, there is provided an automation device 120 adapted and configured to physically engage and operate an existing switch fixture 122 having a switch lever 124 and cover plate 123. In embodiments, the automation device may include a housing 126, at least one self-affixing attachment 140 for holding the housing in position and alignment with the switch and/or cover plate, an actuator 128 located within the housing and configured to actuate a lever 124 of the light switch once the light switch automation device has been installed over the light switch and cover plate, and a controller 132 in communication 130 with the actuator and configured to control the actuator to actuate the lever of the light switch in response to a signal. In some embodiments, a controller 132 may be configured to respond to any inputs and/or signals deemed useful for an application of interest, such as, for example, any one or more of a signal electrically communicated 150 from a button or other user control 136 incorporated into the automation device, a signal communicated wirelessly 156 from a remote device 154 to a receiver 134 in communication 152 with the controller, a signal communicated 148 to the controller from a motion sensor 146, and/or a signal communicated 144 to the controller from a light sensor 142. In embodiments, an automation device may be provided with additional sensors and/or communication components for any useful purpose, such as, for example one or more sensors, transmitters, and/or local or remote user interfaces or displays to provide communication of device status to a user and/or to a remote system for controlling one or more devices.

A significant advantage provided by various embodiments of automation devices as disclosed herein is that installation is rapid and simple, does not require the use of tools, does not require any modification to existing fixtures, and does not expose electrical wiring or require actions that would violate building codes if performed by someone other than a licensed electrician. In embodiments, an automation device may be held in engagement with an existing light switch by an attachment, which may be self-affixing and/or releasable. In embodiments of an automation device for a light switch fixture, an attachment may include any component or combination or plurality of components operable to maintain an automation device in engagement with an existing light switch with a degree of resistance to dislodging adequate for normal operation of the automation device, taking into account the forces required to operate the switch lever. In embodiments, it may be found useful to employ a self-affixing attachment, which may include any attachment modality operable to establish an engagement between the automation device and the existing light switch of adequate strength upon placing the automation device in position and optionally pressing the automation device against the switch plate, making minor positional adjustments to the automation device or a part or component thereof, or otherwise securing the automation device in position without the use of tools and without modifying, removing, or disassembling the light switch, switch plate, or any part thereof. In embodiments, self-affixing attachments may include one or more self-affixing fasteners, such as, for example, hook and loop fasteners, magnets, adhesive strips, micro suction cup pads, silicone adhesive pads, double-sided adhesive tape, 3M command tape, spring clips, gripper clips, adhesive or sticky clay, adhesive backings, and/or liquid or gel adhesives. In embodiments, self-affixing fasteners of more than one type may be employed in combination.

Although the fasteners 140 of the attachment depicted schematically in FIG. 1B are shown in a position on the backing plate 141 of the automation device and approximately adjacent to the switch plate attachment screws 104 of the existing light switch 122, in embodiments a self-affixing attachment may include any one or more self-affixing fasteners disposed in any position(s) operable to produce adequate strength of engagement and resistance to dislodging. In embodiments using magnetic fasteners it may be found useful to position the fasteners as close as possible to ferromagnetic materials present in the existing light switch, such as, for example, ferrous metal screws. Hook and loop fasteners may be positioned, for example, in strips on opposite sides or top and bottom of the backing plate of the automation device and in corresponding locations on the switch plate, or in strips above and below the switch plate and in corresponding locations on the backing plate of the automation device. In embodiments, adhesive backing may be placed covering the entire portion of the backing plate of the automation device that is in contact with the switch plate, or a sufficient portion thereof to ensure adequate strength of attachment.

In embodiments, it may be found useful to employ attachments that are releasable, which may include any attachment whereby the automation device is removable from its engagement with the existing light switch or other fixture by application of outward and/or transverse pressure alone, or by application of outward and/or transverse pressure accompanied by release of one or more spring clips or gripper clips if present, and whereby the normal operability of the existing light switch is restored by such removal. In embodiments, releasable attachments may be implemented by the use of releasable fasteners, such as, for example, hook and loop fasteners, magnets, micro suction cup pads, and spring clips as well as adhesives such as, for example, silicone adhesive pads, adhesive strips, double-sided adhesive tape, adhesive clay, adhesive backings, and/or liquid or gel adhesives, that are formulated to be releasable and/or non-hard curing.

Figure 15:
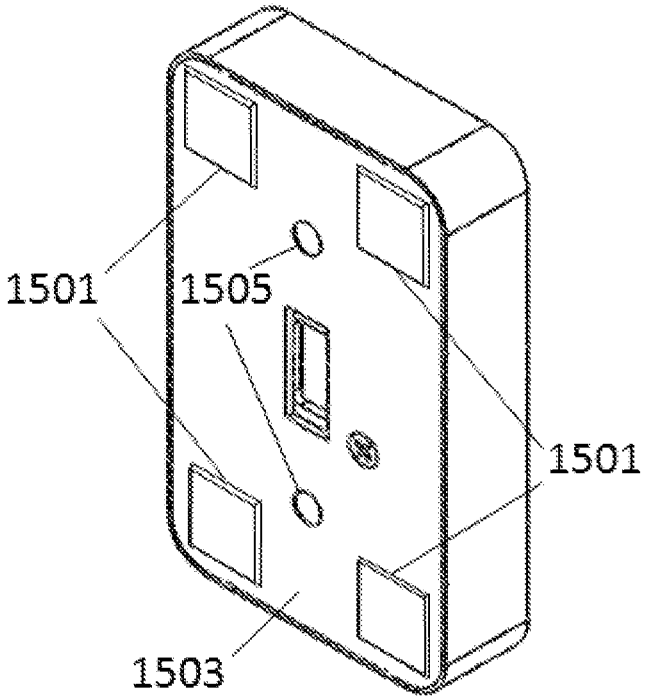
FIG. 15 depicts the positioning of friction pads in an embodiment of an automation device consistent with the disclosure hereof.
Figure 17:
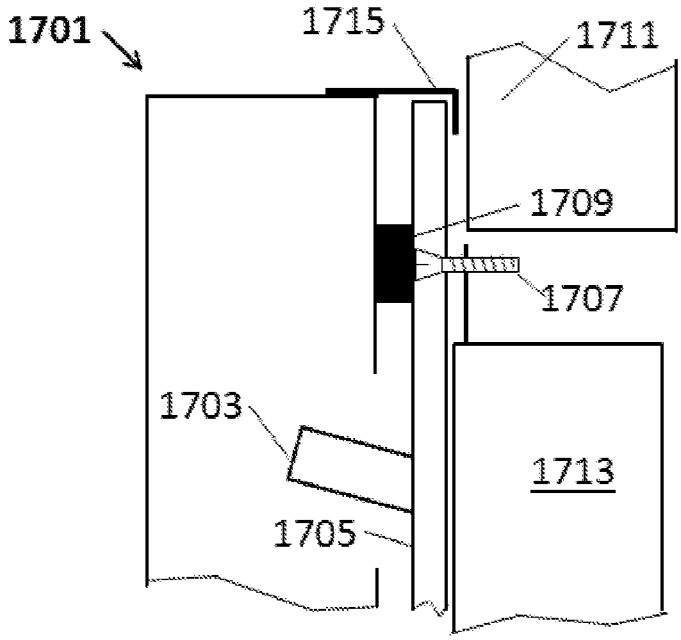
FIG. 17 depicts attachment to a switch fixture of an embodiment of a switch automation device consistent with the disclosure hereof.

In embodiments, stabilizing components may be employed to better ensure the retention of the automation device over the existing switch fixture in an intended position and/or protect against undesired dislodging. Stabilizing components may include any components and/or materials operable to improve the positional stability and/or resistance to dislodging of the automation device in its installed configuration. For example, in some embodiments as illustrated in FIG. 15, there may be provided friction pads 1501, which may be positioned in any manner found to improve the stability of the attachment being employed, such as, in the case of attachment using magnetic fasteners 1505 as illustrated, disposed on a back plate 1503 of an automation device near the corners so as to contact the switch plate of the existing switch fixture once the automation device is installed over the existing switch fixture and provide friction resistance against lateral movement. In embodiments, friction pads may be of any size, geometry, and composition found effective taking into account the attachment modality and configuration with which they are to operate; in general, it may be found useful to employ friction pads having a resilient outer surface, such as rubber or soft plastic having a relative low durometer such as less than 30 A, or less than 20 A, or less than 10 A, and/or having a high friction, slip-resistant, or sticky surface, and/or having a size of at least 1 $cm^2$ in area, or at least 1.5 $cm^2$ in area, or at least 2 $cm^2$ in area. In some embodiments friction pads may have an adhesive coating, which may be a releasable adhesive coating. In embodiments, friction pads should preferably be of a sufficiently small thickness, and/or recessed relative to other portions of the automation device facing the existing switch fixture, so as not to displace the automation device outward from the switch plate of the existing switch fixture and thereby weaken the attachment of the automation device over the existing switch fixture. In some embodiments, one or more physical barriers may be employed to limit the freedom of the automation device to move relative to the existing switch fixture; for example, a barrier 138 such as shown in FIG. 1B may be employed to restrain the automation device against translational movement in a direction parallel to the surface of the switch plate by impinging on the upper boundary of the existing switch plate. In some embodiments as illustrated in FIG. 17, an automation device 1701 may be provided with an edge clasping retainer 1715 extending beyond the edge of a switch plate 1705 and extending a short distance between the switch plate and the surface of the adjacent wall 1711 so as to better secure the automation device in position and resist outward movement away from the switch plate. Although FIG. 17 depicts an automation device installed over a switch fixture 1713 with a toggle-type lever 1703 and employing an attachment using a magnet 1709 to attach by magnetic force to a cover plate screw 1707, it will be apparent that an edge clasping retainer could be used to improve the stability of installation of automation devices of any type, secured by any attachment modality, over any type of fixture having a cover plate as shown. In embodiments, edge clasping retainers may be disposed at any one or more positions and may be of any size and geometry found useful for providing better stability; for example, edge clasping retainers may be made of a resilient or flexible material to facilitate installation and/or release.

In some embodiments, there may be provided an automation device to toggle a lever on a pre-existing fixture by both a button input on the automation device as well as wirelessly from any device capable of communicating on the same wireless communication protocol. These devices may include, but are not limited to, personal computers, smart phones, tablet devices, and wireless gateways.

Figure 2A:
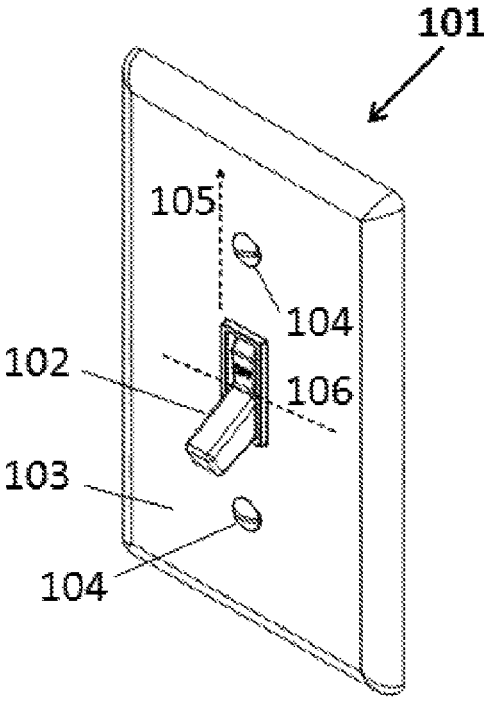
FIG. 2A (PRIOR ART)
FIG. 2A shows an example of a pre-existing toggle-type switch fixture that embodiments of an automation device according to the disclosure hereof could automate.
Figure 2B:
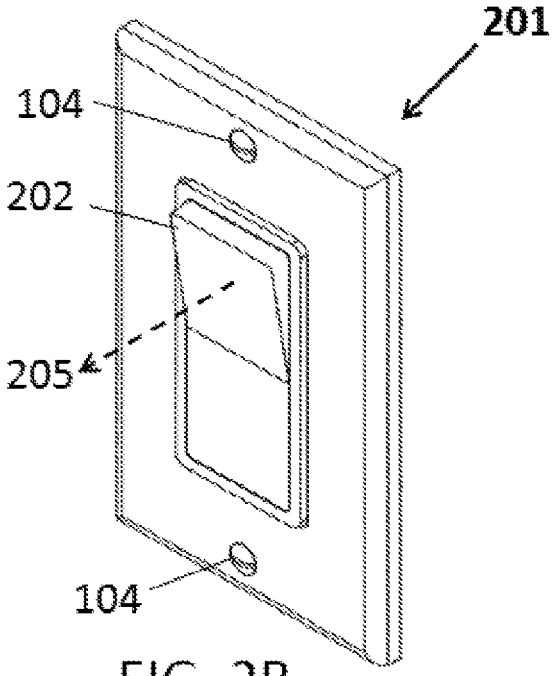
FIG. 2B (PRIOR ART)
FIG. 2B shows an example of a pre-existing rocker-type switch fixture that embodiments of an automation device according to the disclosure hereof could automate.
Figure 2C:
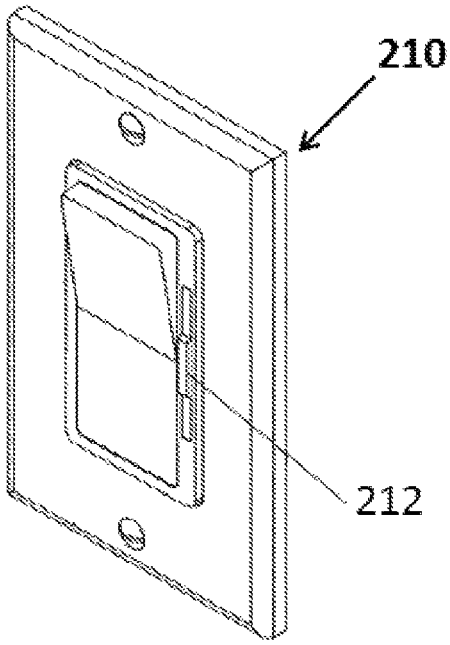
FIG. 2C (PRIOR ART)
FIG. 2C shows an example of a pre-existing rocker-type switch fixture with dimmer control that embodiments of an automation device according to the disclosure hereof could automate.

An automation device may be adapted and configured to control and/or operate an existing switch fixture of any of the many switch designs and configurations available. FIGS. 2A-2C depict several common switch types. FIG. 2A depicts an example of a toggle-type switch fixture 101 that can be controlled and/or operated by embodiments of a switch automation device such as that depicted in FIGS. 3 and 4. FIG. 2B depicts an example of a rocker-type switch fixture 201 that can be controlled and/or operated by embodiments of a switch automation device such as that depicted in FIGS. 8, 9, and 10. FIG. 2C depicts an example of a rocker-type switch fixture 210 including a dimmer control slider 212 that can be controlled and/or operated by embodiments of a switch automation device such as that depicted in FIG. 18. It will be apparent that these are merely examples, and that, in accordance with the teaching hereof and principles disclosed herein, embodiments of automation devices can be constructed compatible with any switch design capable of being controlled or operated by physical motion of an actuator, by adapting the geometry and motion of the actuator to the geometry of the switch and the motion required to control or operate it.

Figure 3:
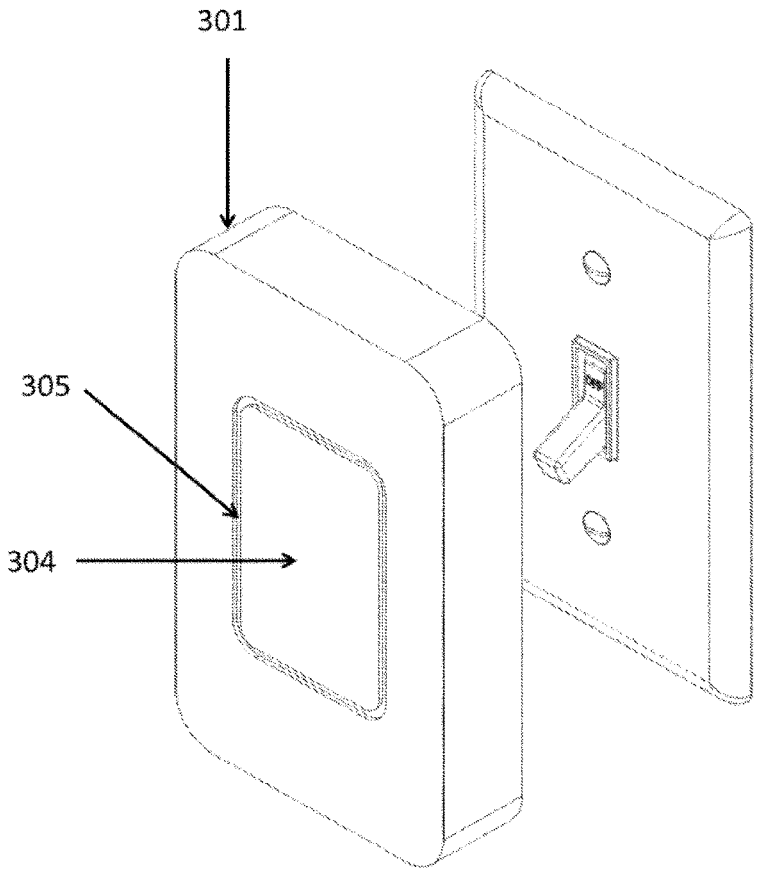
FIG. 3 shows the front cover of an embodiment of an automation device according to the disclosure hereof in the orientation in which it would attach to a toggle-type switch.
Figure 5:
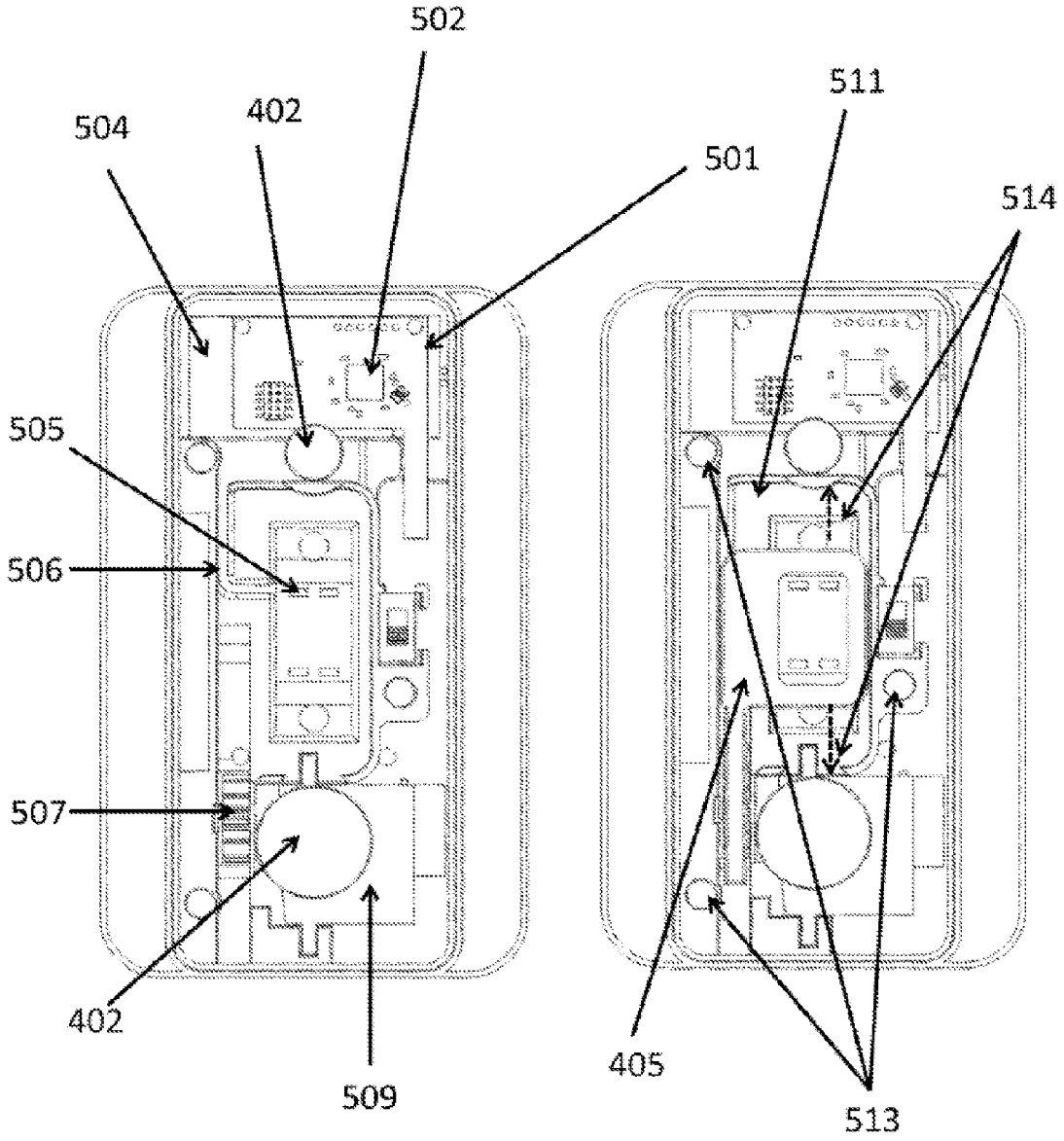
FIG. 5 is an internal view of an embodiment of an automation device according to the disclosure hereof adapted for a toggle-type switch.

In FIG. 3 there is shown the front cover 301 of an embodiment of an automation device including a button input 304. This button input 304 serves as manual method of actuating the lever on the pre-existing fixture as well as providing tactile feedback to the user. The button does not actuate the lever, but rather serves as an input on the internal circuitry which in turn activates a servomechanism to toggle the lever 102 from its previous position. Once the automation device has been installed, the two interfaces to toggle the lever on the pre-existing fixture are through the button input 304 and by a wireless command. In both instances, as illustrated in FIG. 5, a microcontroller 502 receives an input and activates the servomechanism 509. As such, the microcontroller 502 is able to keep track of the state of the lever based on the previous command, foregoing the need of a sensor for this state-tracking. In the embodiment illustrated in FIG. 5, metal screws 104 on the pre-existing fixture as shown in FIG. 2A serve as the attachment points for the magnets 402 on the automation device. (In embodiments as disclosed herein, in lieu of a microcontroller there may be substituted any other device, component, circuit, or combination thereof operable to control other components to perform the functions indicated under direction of a program, logic circuit, or instructions.)

Figure 8:
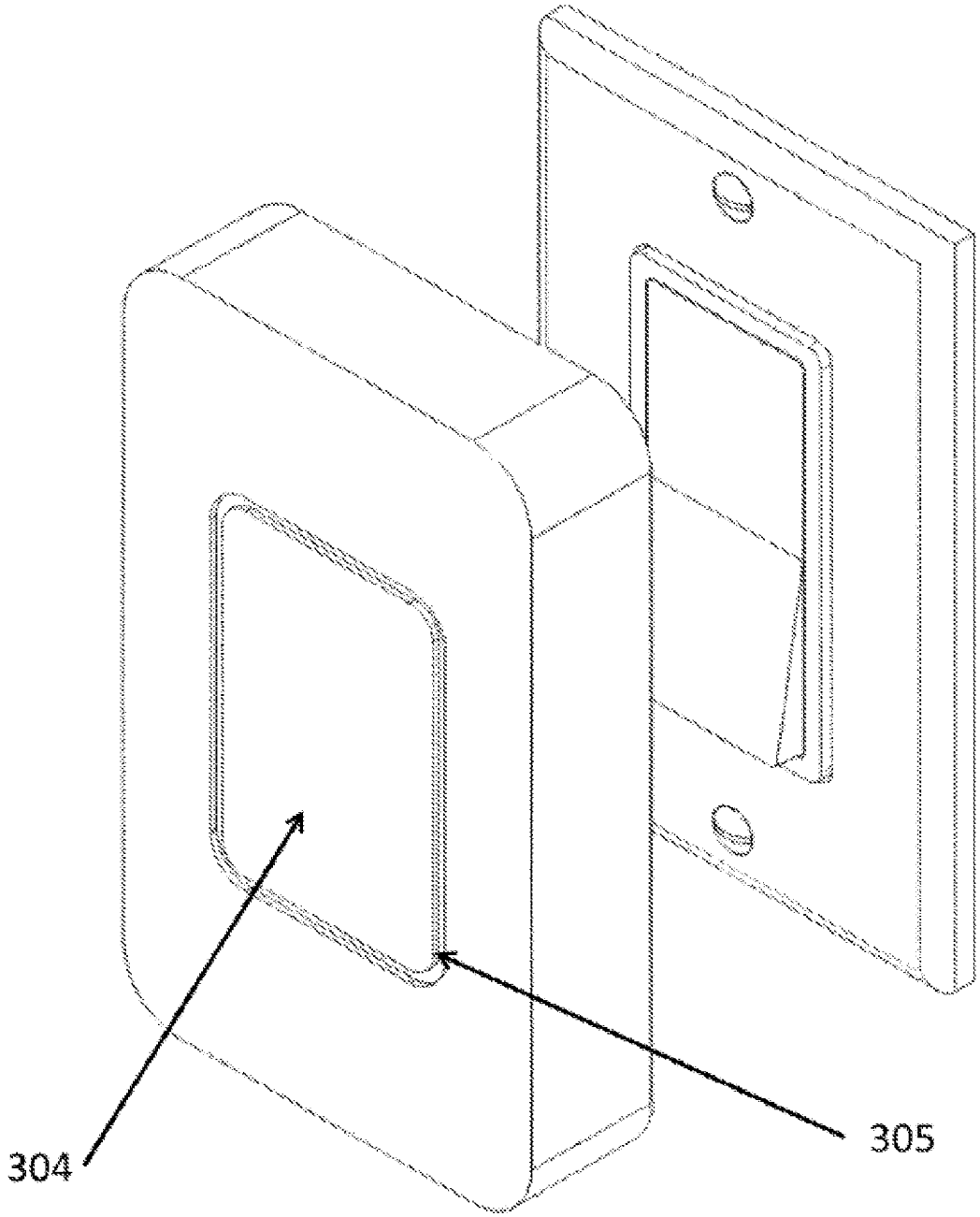
FIG. 8 shows the front cover of an embodiment of an automation device according to the disclosure hereof adapted for a rocker-type switch.
Figure 9:
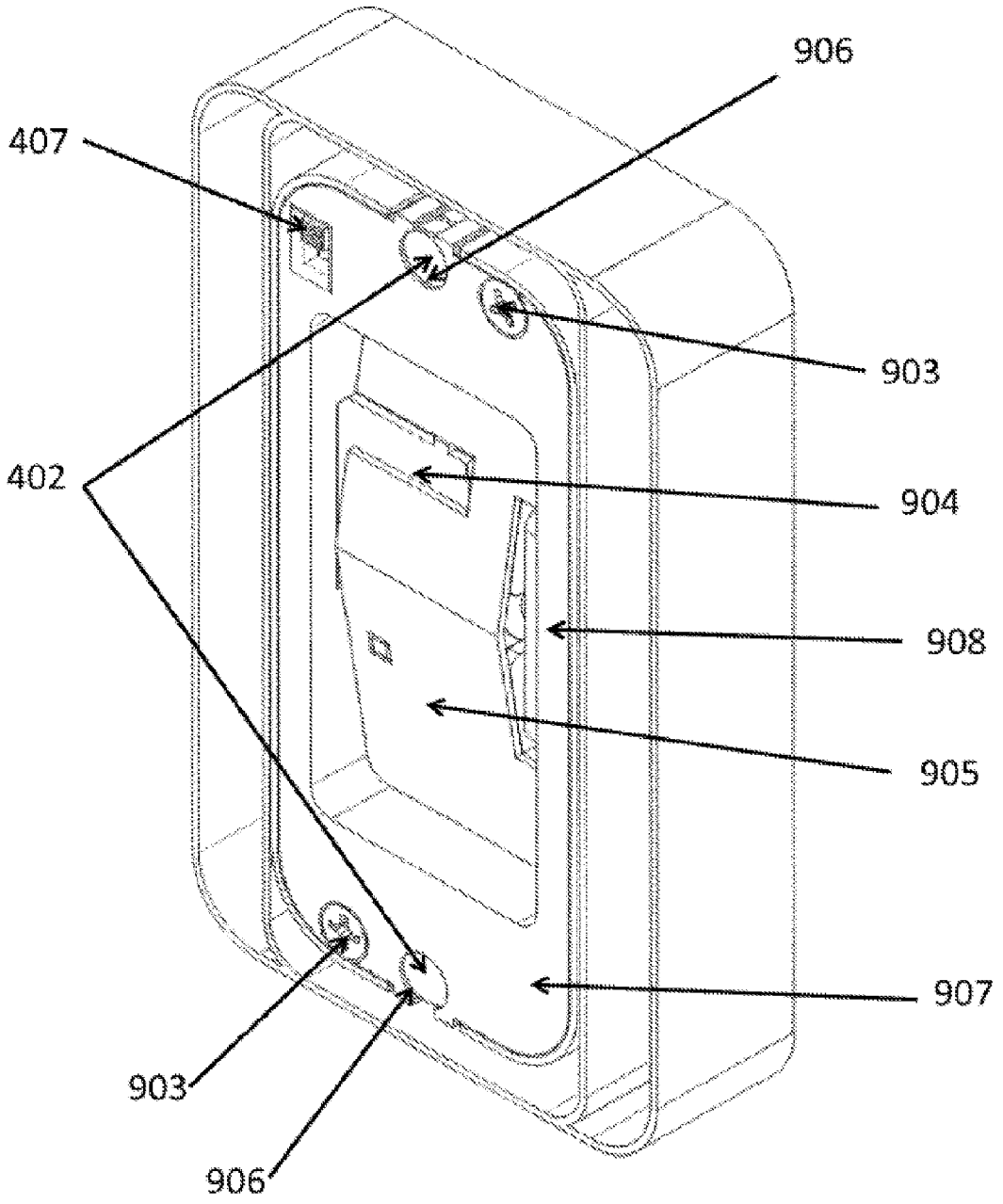
FIG. 9 shows the posterior view of an embodiment of an automation device according to the disclosure hereof adapted for a rocker-type switch.
Figure 10:
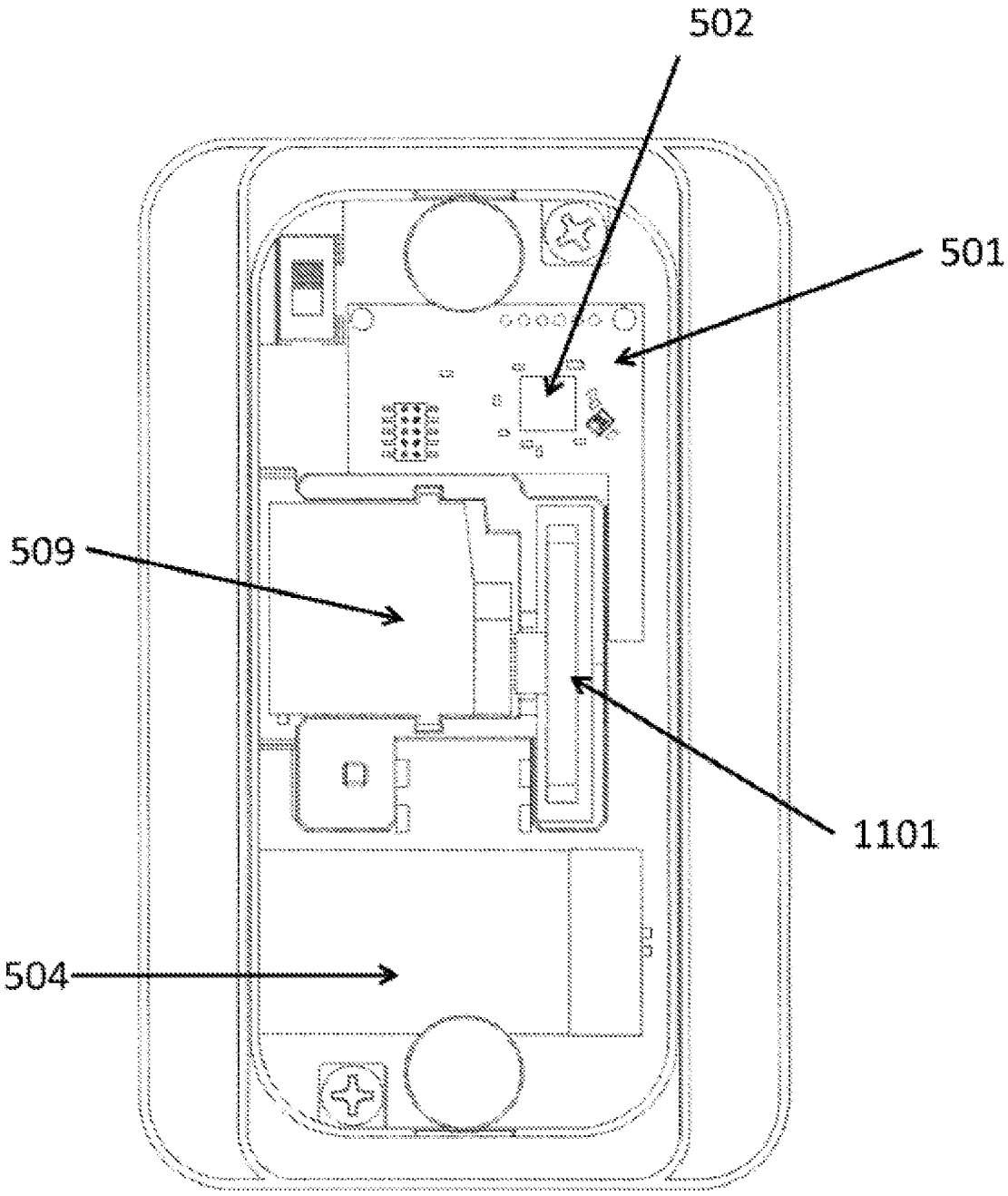
FIG. 10 shows the internal view of an embodiment of an automation device according to the disclosure hereof adapted for a rocker-type switch.

In some embodiments as illustrated in FIG. 3, surrounding the button is a ring 305 of photo-luminescent material intended to improve visibility of the device in poorly lit environments. FIG. 8 depicts an analogous view for an embodiment of an automation device for an existing rocker-type switch fixture, having a broader, flat lever 202 as illustrated in FIG. 2B, with metal screws 104 at a different spacing. The magnets 402 in embodiments of an automation device as illustrated in FIGS. 8-10 may be spaced as appropriate for closest proximity to these metal screws. In embodiments, a button input 304 and a photo-luminescent material 305 may again be included, as illustrated in FIG. 8. Alternatively, in embodiments, any light-emitting material or component may be employed to improve the visibility of the automation device or any component thereof, such as, for example, a passive photo-luminescent material, a fluorescent material, an active component such as a light emitting diode, or an electroluminescent material, and may be disposed in any location, size, and/or arrangement.

Figure 4:
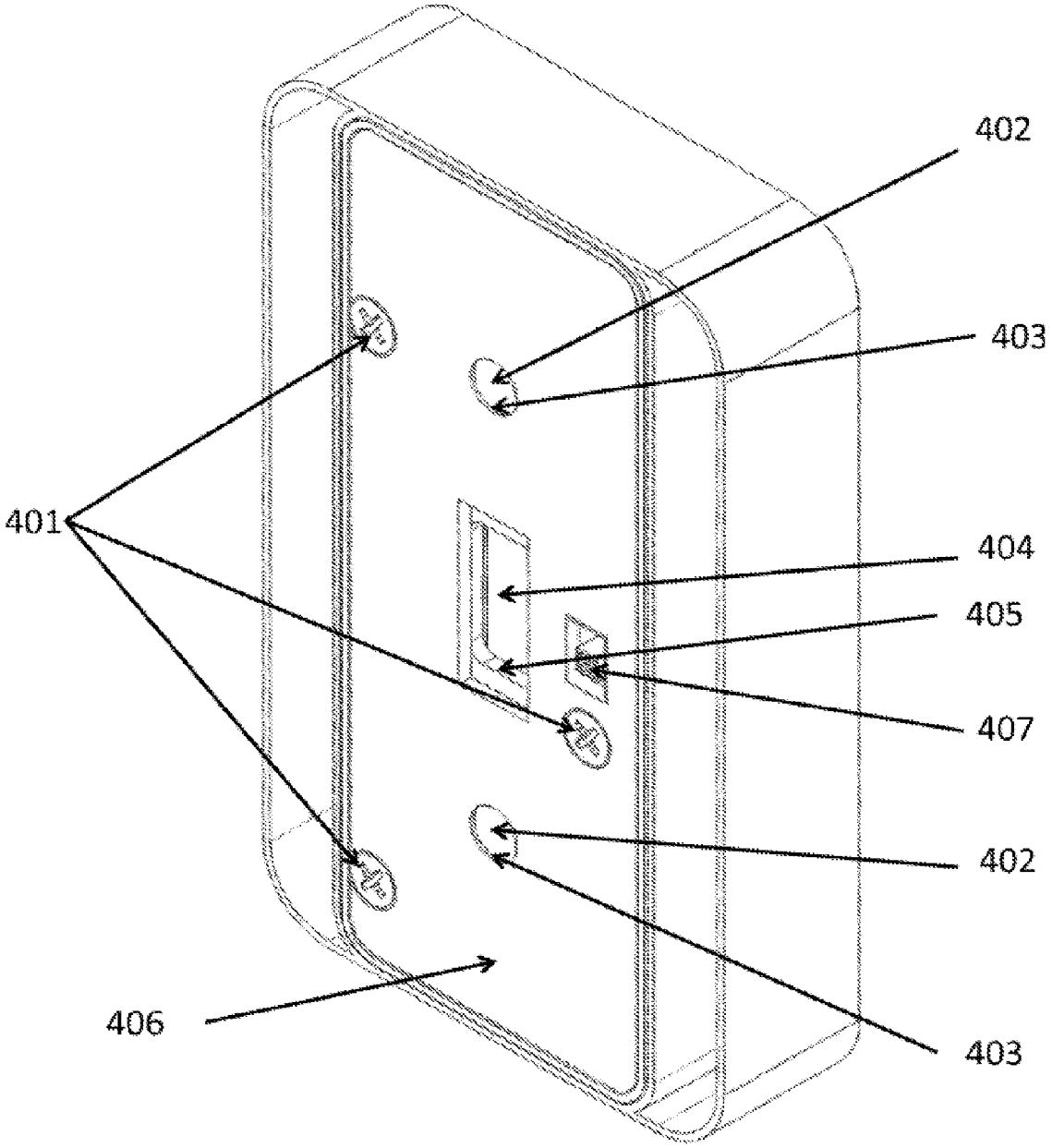
FIG. 4 shows the posterior view of an embodiment of an automation device according to the disclosure hereof adapted for a toggle-type switch.

In FIG. 4 a posterior perspective is shown of an example embodiment of an automation device configured for compatibility with a toggle-type existing switch fixture such as that depicted in FIG. 2A, with a backing plate 406 attached. The backing plate 406 includes two apertures 403, which may be provided with chamfered edges around the magnets 402, spaced apart to match the placement of metal screws 104 of a pre-existing toggle-type switch fixture as shown in FIG. 2A. A rectangular aperture 404 is present in the backing plate to allow for the lever of the pre-existing fixture to protrude through and be actuated by the internal rack 405. Similarly, in FIG. 9 a posterior perspective is shown of an embodiment of an automation device configured for compatibility with a rocker-type existing switch fixture such as that depicted in FIG. 2B, with a backing plate 907 attached using screws 903 or in any other operable manner, and with a rack 904 and platen piece 905 provided to operate the rocker lever of the existing switch fixture. Two apertures 906, which may be provided with chamfered edges, surround magnets 402, spaced apart to match the placement of the metal screw 104 of a pre-existing rocker-type switch fixture such as that shown in FIG. 2B. In some embodiments where magnetic attachment is employed, chamfering of the magnet apertures may improve the alignment of the automation device by providing a better match for the hemispherical heads of screws commonly present on toggle and rocker switches. In some embodiments, the stability of the attachment may be improved by careful positioning of the magnets along the axis perpendicular to the plane of the backing plate whereby the magnets are as close as possible to the metal screws to which they are intended to attach, without protruding to a degree that would destabilize other desired points of contact between the automation device and the existing switch fixture and/or switch plate. In some embodiments, an automation device may be configured for use with an existing switch fixture having metallic screws that are hidden beneath the switch plate; in such embodiments, it may be preferable to position magnets flush with the surface of a backing plate of the automation device, and optionally to employ larger or stronger magnets and/or employ the magnetic attachment in combination with other attachment modalities or stabilizing components as disclosed herein.

Figure 7:
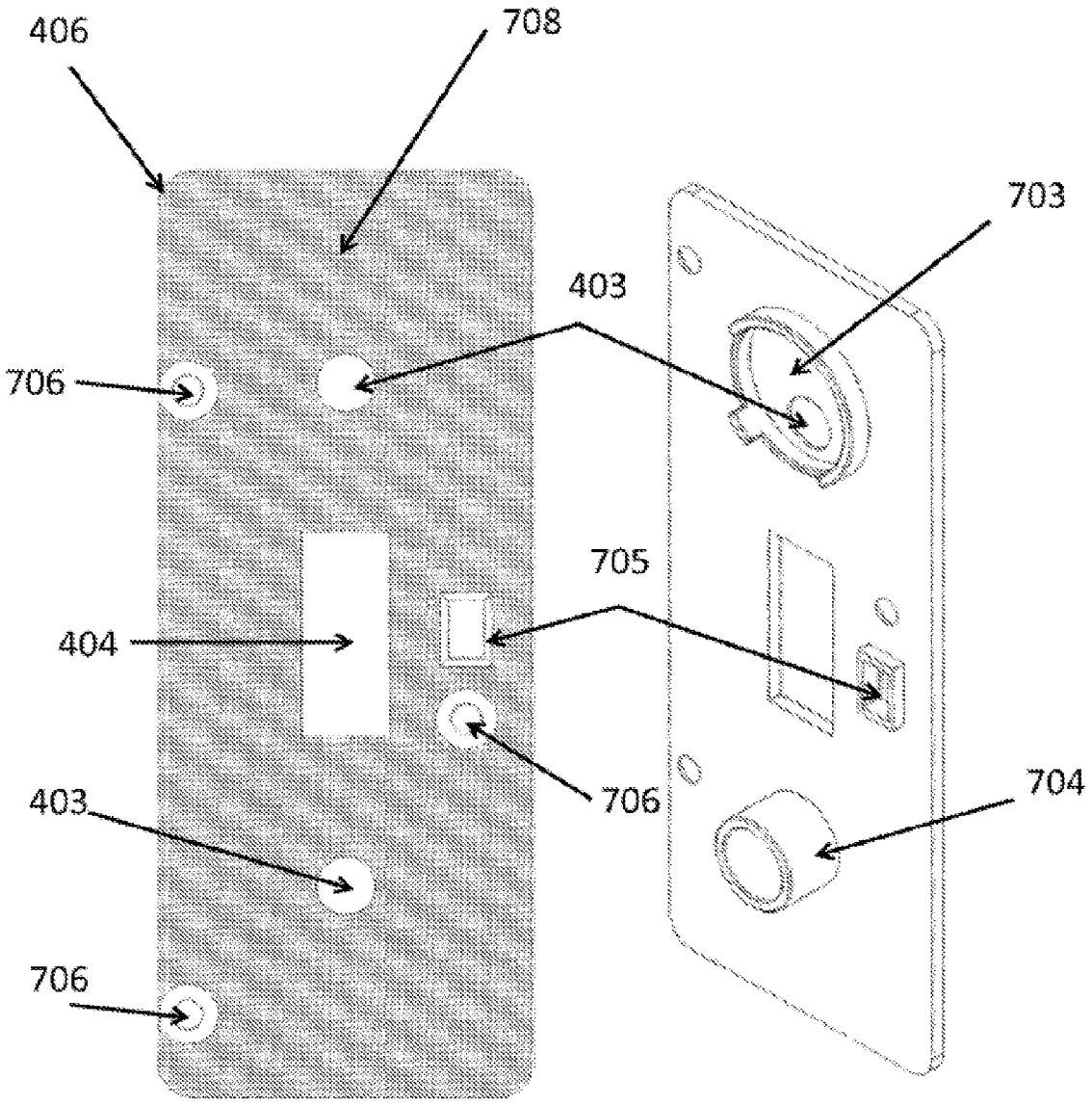
FIG. 7 is a posterior and perspective view of the back cover for an embodiment of an automation device according to the disclosure hereof adapted for a toggle-type switch.

In an illustrative embodiment of an automation device configured to operate and/or control a toggle-type switch as depicted in FIG. 2A, as the automation device actuates the lever 102 on the toggle switch in the direction 105 shown, an equal but opposite force in this plane, parallel to the surface 103 of the switch plate, is produced due to the internal spring of the toggle switch. As illustrated in FIG. 7, to counter this force and prevent the device from moving during actuation, a material 708 capable of providing sufficient frictional force may be coated on the backing plate 406. Similarly, as shown in FIG. 9, in embodiments configured for a rocker-type switch, a backing plate 907 may also include this material on its surface 908, and/or friction pads may be employed. Sufficient frictional force may be met by the material providing a frictional force between the backing plate and the surface of the pre-existing fixture such that the frictional force is greater than or equal to the force required to actuate the lever on the pre-existing fixture. In the example of a toggle-type switch, the force required to be applied to actuate the lever may be approximately 11.1 N (2.5 pounds). In some embodiments, and depending upon the switch design and condition, the force required to be applied to actuate a toggle-type lever may be greater than approximately 12 N (2.7 lbf), or between approximately 9 N (2.0 lbf) and 12 N (2.7 lbf), or between approximately 6 N (1.35 lbf) and 9 N (2.0 lbf), or between approximately 3 N (0.67 lbf) and 6 N (1.35 lbf), or less than approximately 3 N. A material capable of providing sufficient frictional force to counteract the actuating force of the automation device would also typically be sufficient for a rocker-type switch 201 since the force generated during actuation for this type of switch is primarily orthogonal to the surface of the switch, as depicted in FIG. 2B in direction 205. Examples of a coating can include, but are not limited to, polyurethane and silicone. However, a permanent coating need not be used; an alternative solution could include a temporary or pressure sensitive adhesive such as rubber, standard acrylic, and silicone on the backing plate. In embodiments of automation devices, such as an automation device configured for a toggle-type existing switch fixture as illustrated in FIG. 4 or an automation device configured for a rocker-type existing switch figure as illustrated in FIG. 9, a toggle switch 407 may be provided to power the automation device on and off.

FIG. 5 depicts the interior of the front cover of an embodiment of an automation device configured to control and/or operate a toggle-type existing switch fixture, and FIG. 10 depicts the interior of the front cover of an automation device configured to control and/or operate a rocker-type existing switch fixture, each holding many of the internal components. Specifically for the toggle-type device illustrated in FIG. 5, holes 513 for the screws 401 (see FIG. 4) meant to attach the back plate 406, a path 505 to guide wires from the button input 304, and a gear rack 506 are shown. A filleted track 511 is made to provide a guiding track for the motion of the rack 405 as it is actuated by the pinion 507 on the head of the servomechanism 509 in two directions 514. A battery 504 is provided to supply power to the automation device.

Figure 6:
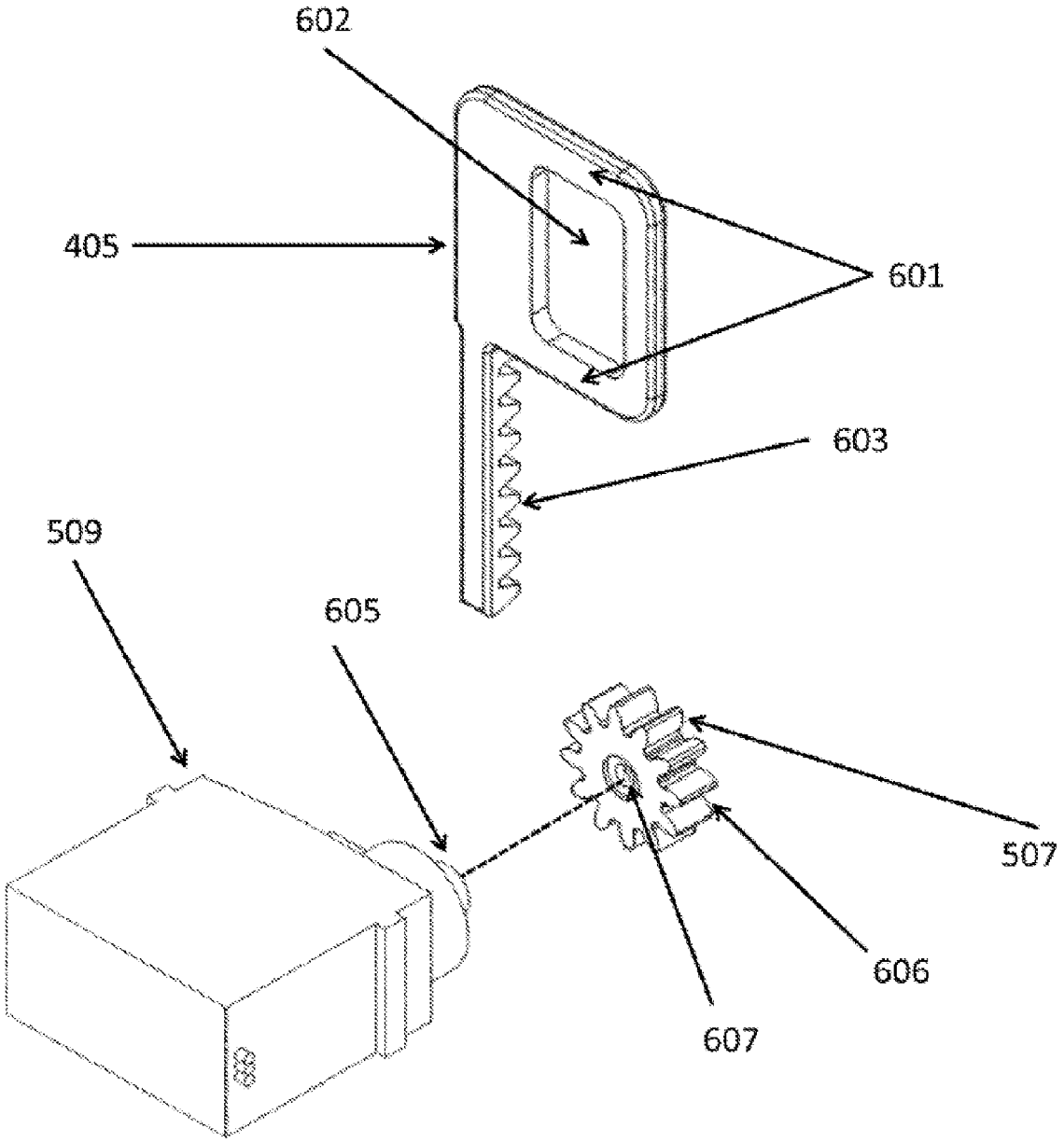
FIG. 6 is a perspective view of the rack, pinion, and servomechanism for an embodiment of an automation device according to the disclosure hereof adapted for a toggle-type switch.

FIG. 6 shows a rack 405 and a pinion 507 for an embodiment of the toggle-type automation device in greater detail. The rack contains an aperture 602 to allow the lever 102 of the pre-existing fixture to protrude through. The teeth 603 of the rack match the teeth 606 of the pinion 507 to allow for smooth actuation. A small aperture 607 on the pinion allows it to be held in place onto the servomechanism head 605 with a screw. In this rack and pinion configuration, a servomechanism was selected to provide sufficient torque. The rack actuates the lever 102 of the toggle switch at approximately 0.2 inches from the surface 103 of the toggle switch. As stated previously, some toggle switches require approximately 11.1 N (2.5 lbf) to flip. For such switches, the inventors have determined that sufficient torque is met by being able to provide a minimum peak force of 11.1 N (2.5 lbf) at a lever arm distance of 0.5 cm (0.2 inches). In this scenario, the servomechanism should preferably have a torque output exceeding approximately 0.056 N-m (0.5 lbf-in). In embodiments configured for toggle-type switches that differ from the foregoing in the amount of force required to operate the switch lever, or that present different geometry resulting in a different lever arm, servomechanisms may be selected having torque output of at least 0.022 N-m (0.2 lbf-in), or at least 0.033 N-m (0.3 lbf-in), or at least 0.045 N-m (0.4 lbf-in), or at least 0.056 N-m (0.5 lbf-in) or at least 0.067 N-m (0.6 lbf-in), as may be effective according to the characteristics of a particular switch type.

Figure 11:
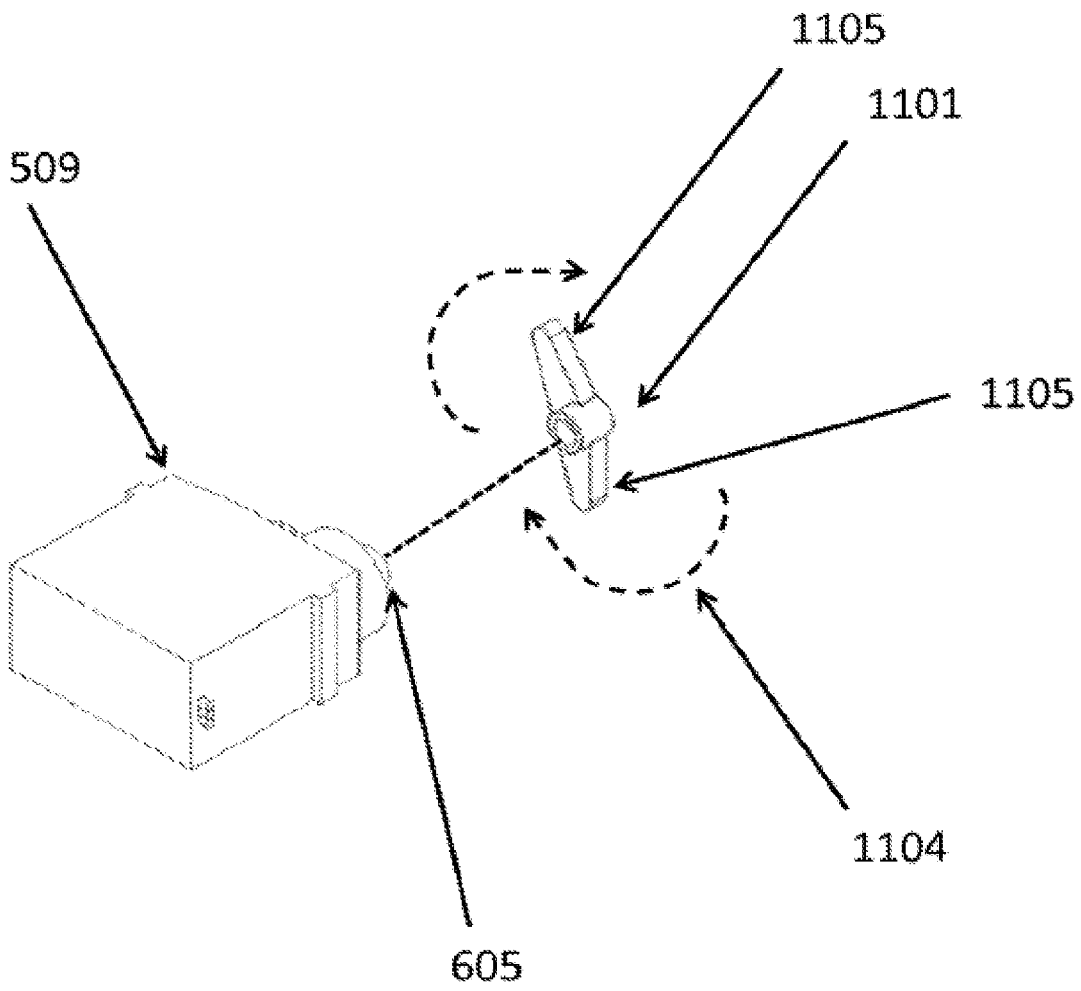
Figure 12:
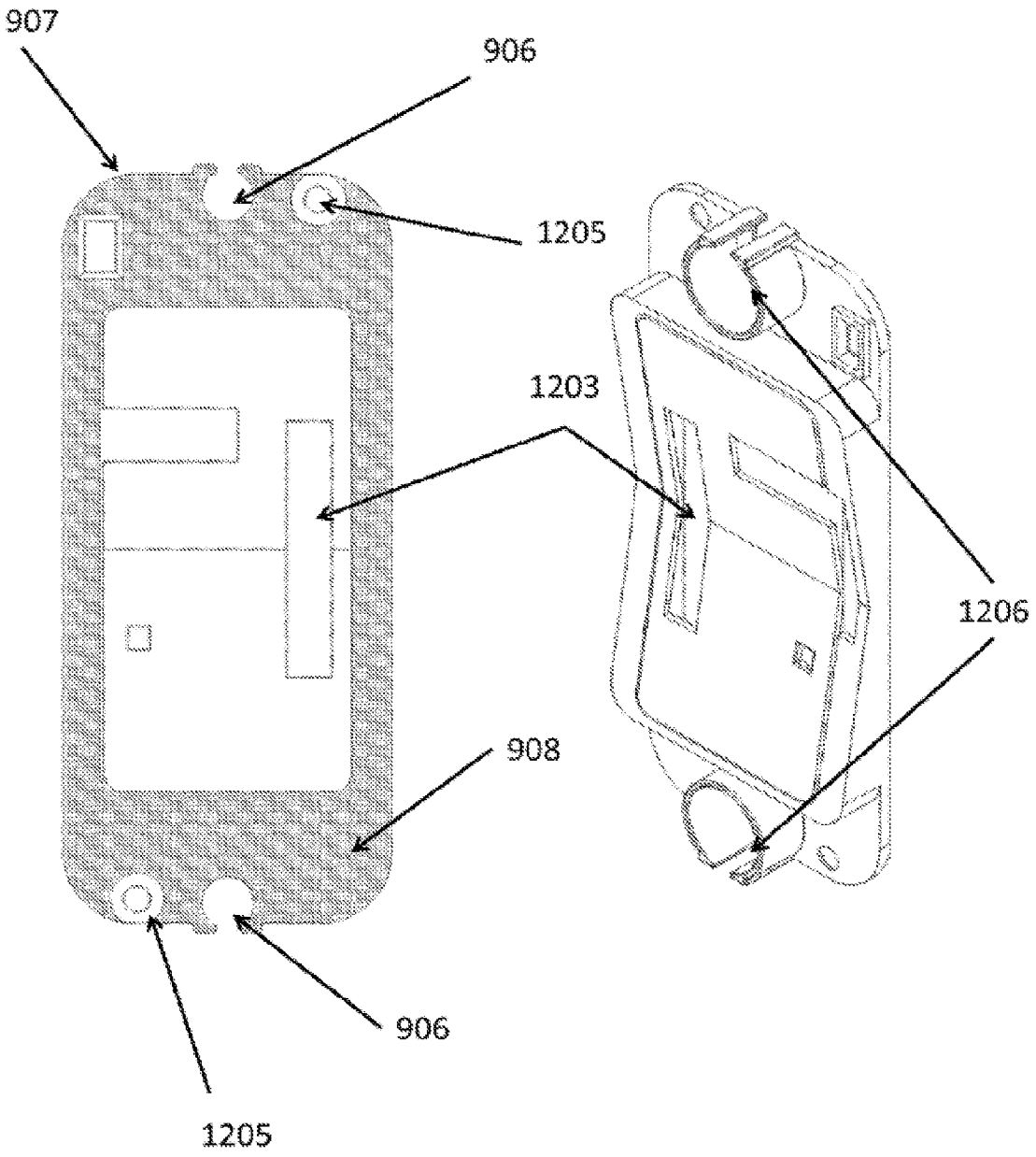
FIG. 12 shows the posterior and perspective view of the back cover for an embodiment of an automation device according to the disclosure hereof adapted for a rocker-type switch.

In an embodiment of an automation device configured to control and/or operate a rocker-type existing switch fixture of the general type illustrated in FIG. 2B, the device actuates a broad, flat lever switch and therefore has different torque requirements. FIG. 11 depicts the rotational head 1101 as well as the head 605 of the servomechanism it attaches to. This rotational head has a rotational motion 1104 which allows the fins 1105 of the rotational head to directly contact the lever 202 of the rocker switch. These fins can protrude through an aperture 1203 of the backing plate 907 as illustrated in FIG. 12 to make contact with the rocker switch. Rocker-type switches may require up to 4.4 N (1 lbf) of force to toggle and the fins 1105 create a lever arm distance of approximately 2.3 cm (0.9 inches), creating a torque requirement of approximately 0.10 N-m (0.9 lbf-in) for the servomechanism. It will be apparent that torque and force requirements may vary depending on the characteristics of the existing switch fixture. Therefore, in embodiments, it may be found useful to employ a servomechanism providing an approximate torque of at least 0.022 N-m (0.2 lbf-in), or at least 0.033 N-m (0.3 lbf-in), or at least 0.045 N-m (0.4 lbf-in), or at least 0.056 N-m (0.5 lbf-in) or at least 0.067 N-m (0.6 lbf-in), or at least 0.090 N-M (0.8 lbf-in), or at least 0.11 N-m (1.0 lbf-in), as may be found effective for an application of interest.

For automation devices for existing switch fixtures generally, including toggle-type and rocker-type switches, there is energy lost due to friction and the torque may not be applied directly orthogonally. To compensate for this, a safety factor may be incorporated. For example, for the rocker-type embodiment described in the preceding paragraph, a safety factor of approximately 1.5× was incorporated and a servomechanism with a torque output of approximately 0.16 N-m (1.4 lbf-in) was selected.

Figure 18A:
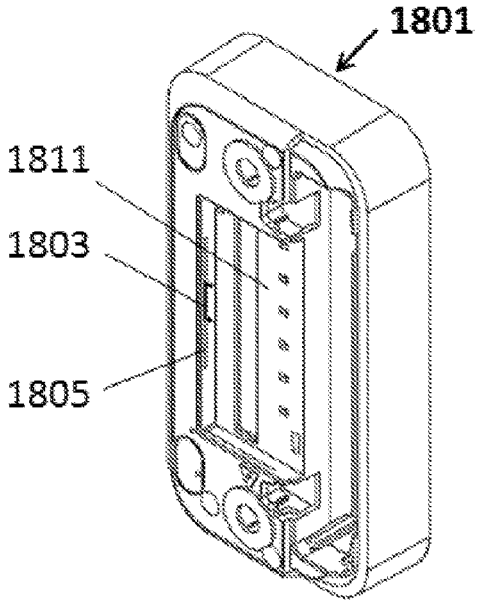
FIG. 18A depicts the back portion of an embodiment of a switch automation device consistent with the disclosure hereof, including an actuator for engaging a dimmer control.
Figure 18B:
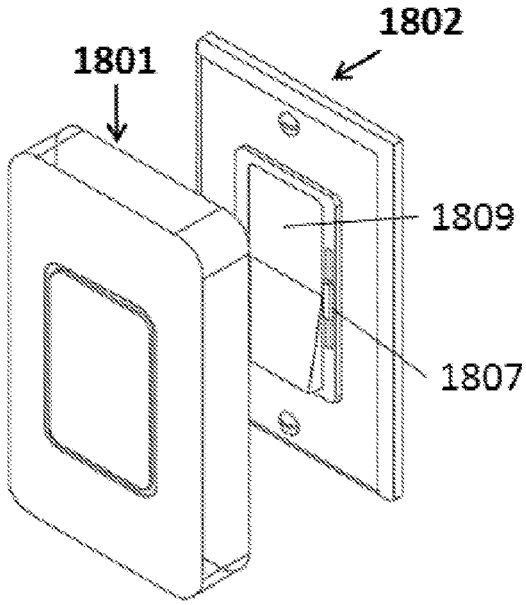
FIG. 18B depicts an embodiment of a switch automation device consistent with the disclosure hereof in orientation for installation over a switch fixture including a dimmer control.

The methods, devices, components, systems, and principles disclosed herein may be employed to make and use other embodiments of automation devices configured to control and/or operate controllable fixtures of any kind, by adapting the housing, attachment, actuator, and controller and control logic to the geometry and mode of operation of the fixture. Thus, for example, there is provided as illustrated in FIGS. 18A and 18B an embodiment of an automation device 1801 configured to control and/or operate a rocker-type switch 1802 having in addition to the rocker lever 1809 a slider 1807 configured as a dimmer control to allow a user to control the intensity of a light source by moving the slider along a track. As shown in FIG. 18A, adjacent to the rocker lever engaging portion 1811 of the automation device there is provided an engager 1803, positionable along a track 1805 by an actuator within the device controllable by a controller, and configured to engage and move the dimmer slider. The engager and track may be of any geometry and configuration operable to engage the dimmer slider and move it in a desired manner. In a similar fashion, a switch fixture including a rotary-type dimmer may be accommodated, using a rotary actuator and an engager configured to engage with the control provided.

In embodiments of automation devices, such as, for example, for the toggle-type and rocker-type embodiments described herein as illustrated in FIGS. 5 and 10 respectively, a microcontroller 502 on a circuit board 501 contains logic for scheduling timers, proximity detection, and range of motion. Optionally, additional logic may be provided to respond to inputs and provide smart functionality of any kind deemed useful for an application of interest, such as, for example, inputs from one or more motion sensors, ambient light sensors, and/or control devices. Timers can be set by wireless commands using devices such as smart phones, personal computers, and tablets. The firmware implementation on the microcontroller allows these timers to be recurring on a daily, weekly, and monthly basis. Random number generators within the microcontroller also allow for the randomization of these timers. The wireless module is also able to detect proximity of another device operating on the same wireless protocol using on-board hardware capable of measuring received signal strength. This value, known as received signal strength indicator (RSSI), is a measurement of power received by the antenna on the wireless module. As another wireless device is brought closer to the antenna, the power received would also increase, providing a means of measuring an approximate distance between devices. Using this value, logic can be implemented on the microcontroller that is able to activate the servomechanism to change the state of the lever on the pre-existing fixture. As an example, a user can create a setting with a smartphone to have the automation device change the state of the toggle switch to "on" when the user is within range. The microcontroller on the automation device can use logic such that when the RSSI value is greater than or equal to a predetermined threshold value, such as, for example, −80 dBm, the microcontroller will activate the servomechanism to flip the toggle switch to the "on" position. The user would then be able to have lights turn on automatically without needing to explicitly send a command upon entering the home. The RSSI value which serves as the threshold for an actuation event to occur can be set by the user or a default value can be used based on needed sensitivity and range. The microcontroller logic for actuating the servomechanism is explained in the subsequent paragraphs.

Figure 16:
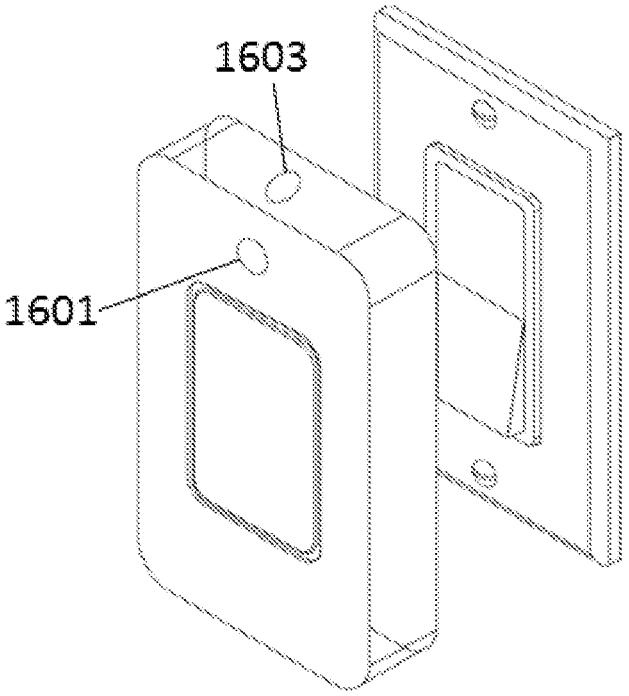
FIG. 16 depicts an embodiment of a switch automation device consistent with the disclosure hereof, including a motion sensor and a light sensor.

In some embodiments as illustrated in FIG. 16, an automation device may include a motion sensor 1601 or other proximity sensor configured to detect, quantify, and/or characterize motion and/or proximity of a body in a region near the device. As illustrated schematically in FIG. 1B, a motion sensor 146 may be configured to communicate a signal over a communication channel 148 to a controller 132, which may implement logic to influence the action of an actuator or servomechanism 128. In some embodiments as illustrated in FIG. 16, an automation device may include a light sensor 1603 configured to detect, quantify, and/or characterize light impinging on the sensor. As illustrated schematically in FIG. 1B, a light sensor 142 may be configured to communicate a signal over a communication channel 144 to a microcontroller 132, which may implement logic to influence the action of an actuator or servomechanism 128. The foregoing examples are illustrative and non-limiting, and sensors of any desired type may be incorporated, configured to communicate signals to and/or from a microcontroller, and thereby produce a desired action in an automation device. A microcontroller may be programmed or configured to respond to signals from sensors in accordance with any logic and/or program found useful for an application of interest, such as, for example, activating the automation device to actuate the switch lever of an existing switch fixture to the "on" position upon detecting nearby motion above a predetermined threshold, which may, in embodiments, be a default threshold or a user-determined threshold; discriminating between motion, proximity, and/or light signals so as, for example, to avoid responding to certain signals such as those generated by pets, movement outside the area of interest, or other extraneous signals; and avoiding actuation of an existing switch fixture to the "on" position when ambient light above a predetermined threshold is present. In embodiments of automation devices as disclosed herein, a communication channel may include any device, component, or combination thereof operable to communicate a signal from a source to a destination, such as, for example, one or more of a wire, a bus, a cable, an optical fiber or fiber bundle, a conductive path on a circuit board, a wireless device, an infrared device, an interface, or a connector. In embodiments a communications channel should preferably be compatible with the source and destination and the type and characteristics of the signal to be communicated.

In FIG. 5, the internals of an example embodiment of an automation device configured to control and/or operate a toggle-type switch fixture is shown with the rack 405 in the center position. The pinion 507 below the rack 405 is able to rotate from 0-180° by the servomechanism 509. Upon power-up of the device, the microcontroller provides a pulse width modulated signal to the servomechanism to move the servo head to the center position (90° position) and move the rack 405 to the center position of the fillet 511. This center position is denoted the "90° position" of the pinion 507. This center position ensures that the rack does not interfere with the lever 102 on the pre-existing fixture 101 (see FIG. 2A) during installation. FIG. 4 depicts the posterior of the device with the backing plate when the rack is in the center position. When a command is received to actuate the lever on the pre-existing fixture, a PWM (pulse width modulation) signal is sent for 350 milliseconds corresponding to either the 0° position or 180° position, moving the rack 405 to the top or bottom of the filleted track 511, respectively. During this actuation, the lever 102 protrudes through the aperture 602 of the rack 405. As the rack moves, the edges 601 of the rack 405 come in contact with the lever 102 and exert a force on the lever in a direction parallel to the surface 103 of the toggle switch. Toggle switches may have an inherent spring which returns them to their previous state if the lever 102 is not moved beyond the center axis 106. To counter this spring action and prevent false flips, the microcontroller returns the rack 405 to an offset position from end positions (0° or 180°). This is done by the microcontroller first providing a PWM signal for 350 milliseconds corresponding to 0° or 180°, depending on the command received. Due to the variability of the thickness of the lever 102 on toggle switches, in these positions (0° or 180°), the rack may be in a state where it is exerting torque on the lever but the lever cannot move any further. In this state, the servomechanism is at stall and can be damaged should it remain in this state. After the microcontroller has provided a PWM signal for 350 milliseconds, the microcontroller provides a second PWM signal for 100 milliseconds corresponding to a 10° offset from these end state positions (10° or 170°). This returns the rack to a state where the edges 601 are no longer in contact with the lever 102 on the toggle switch. In some embodiments, it may be found useful to provide a lip extending outward from the upper and/or lower edge portions 601 of the rack 405 for better engagement with, for example, a non-standard switch toggle.

In an example embodiment of an automation device configured to control and/or operate a rocker-type switch fixture as depicted in FIG. 10 the microcontroller also supplies a PWM signal but has a closed loop control system based on the current consumption of the servomechanism. The torque generating component of a servomechanism is a DC motor. For a DC motor, the current drawn is directly proportional to the torque output of the motor. Motor current at stall and various loads can be measured experimentally or retrieved from a data sheet. Therefore, by measuring motor current it is possible to detect when the DC motor inside the servomechanism has stalled. Current consumption of the servo is measured by the voltage drop across a shunt resistor in series with the power line of the servomechanism. This voltage drop is amplified such that the stall current of the servo corresponds to 90% the maximum value the ADC (analog to digital converter) on the microcontroller is capable of measuring. As the servomechanism actuates the rocker switch, the current increases, due to increasing load, until it has completely flipped the switch. Once the rocker switch cannot move any further, the servomechanism reaches the stall current. The microcontroller is able to detect this stall by the ADC measurement and the microcontroller supplies a PWM signal to return the rotational head 1101 to the state depicted in FIG. 10, parallel to the surface of the backing plate 908. This feedback system prevents the servomechanism from actuating the rocker switch after it has already been toggled and prevents the motor from remaining in a stalled state. During actuation of the rocker switch, an equal but opposite force is generated in an orthogonal direction 205 to the surface of the switch as illustrated in FIG. 2. As mentioned earlier, for some rocker-type switches, this force is approximately 4.4 N (1 lbf). Therefore the magnets 402 shown in FIG. 9 must be able to provide at minimum this attachment force. To improve the attachment integrity of the device, neodymium magnets (N52) 402 were selected such that there was a safety factor exceeding 5×(22 N (5 lbf) of pull force) and the dimensions were constrained such that the magnets did not come into contact with any internal components or increase the thickness of the automation device overall.

FIG. 7 shows a posterior and perspective view of the backing plate 406 consistent with an example embodiment of an automation device configured to control and/or operate a toggle-type switch fixture. Three apertures 706 allow this backing plate to be mounted onto the frontal cover with screws, although this need not be the only mechanism of attachment. A weld or adhesive could also be used for attachment. Compartments 703 and 704 house neodymium magnets; apertures 403 within these compartments allow the magnets to directly contact metal screws on the pre-existing fixture. An aperture 705 may be provided to allow operation of a power switch for activating and/or deactivating the device.

FIG. 12 shows the posterior and perspective view of the backing plate consistent with an example embodiment of an automation device configured to control and/or operate a rocker-type switch fixture. Similarly, two apertures 1205 allow this backing plate to be mounted to the frontal cover with screws. Compartments 1206 are provided for the placement of neodymium magnets to contact the metal screws on the pre-existing fixture. Apertures 906 allow for this direct contact between the magnets and metal screws.

With communication protocols such as Bluetooth, Bluetooth Low Energy, and Zigbee, it is possible to control the automation device from a maximum range of approximately 150 meters. In embodiments, in order to increase the range of the automation device beyond this range, the device can incorporate a wireless local area network module, such as Wi-Fi, or communicate to a wireless gateway with wireless local area network capabilities. It would then be possible to send commands to the automation device from any device capable of joining this wireless local area network, regardless of distance. These commands can include scheduling timers, requests for status of the state of the lever, and toggling of the state of the lever. As mentioned earlier, the state of the lever is known because the microcontroller is able to keep track of the last command received.

In addition, in embodiments wherein a wireless gateway is capable of communicating with three or more automation devices, it would be able utilize a technique known as trilateration to create a physical map of the position of other wireless devices within range. As an example, each of the three automation devices would provide the gateway with their respective signal strength to a smart phone. Using these three values with the trilateration algorithm, the gateway would be able to approximate the relative location of the smart phone, effectively creating an indoor positioning system. Based on this information, it could send commands to the automation devices such as toggling the state of the switch they automate. An example of how this can be used would be that the user can implement logic through a smartphone such that if the user is near two automation devices (e.g. RSSI value>−50 dBm) and further from the third (e.g. RSSI value<−70 dBm), the gateway can send a command to have the third automation device toggle the state of the pre-existing fixture to turn lights off. The RSSI threshold values for this logic can be set by the user or set to default values.

While embodiments of this system have been described to communicate with the Bluetooth Low Energy protocol, it need not be limited to this and could operate with a protocol more suited for a mesh network such as Zigbee or Z-wave, or may operate with any other wireless protocol and/or technology now existing or available in the future. This would allow multiple automation devices to communicate with one another and effectively increase the range of communication to send and receive commands. Since the devices may be made capable of communicating with one another, they could provide signal strength values to one another and create an indoor positioning system without the need of a wireless gateway, as described in the previous paragraph. As an example, two automation devices could provide their respective measured signal strength to a smart phone to a third automation device. This third automation device could then use these two values, in addition to its own measured signal strength, and apply the trilateration algorithm to map the location of the smartphone. As mentioned in the previous paragraph, the user can implement logic to toggle the state of the pre-existing fixture based on measured RSSI values.

In embodiments, if an automation device is used with a smartphone or web portal, the user has the ability to name each automation device on the smartphone app and/or web portal. If the user were to use a name such as "front door" or "back yard", the app can make the assumption that the automation devices have been installed near the front and back of the house, respectively. A third device which does not have any keywords such as "front" or "back" can be assumed to be between two such devices. To prevent false positives, the user can also provide the app with the approximate distance of the device from the front of the house. With this information, it is possible to provide the relative location of another Bluetooth or Zigbee device within the home. As an example, it would be possible to calculate the approximate location of a child, wearing a Bluetooth low energy bracelet, within a home.

Figure 13:
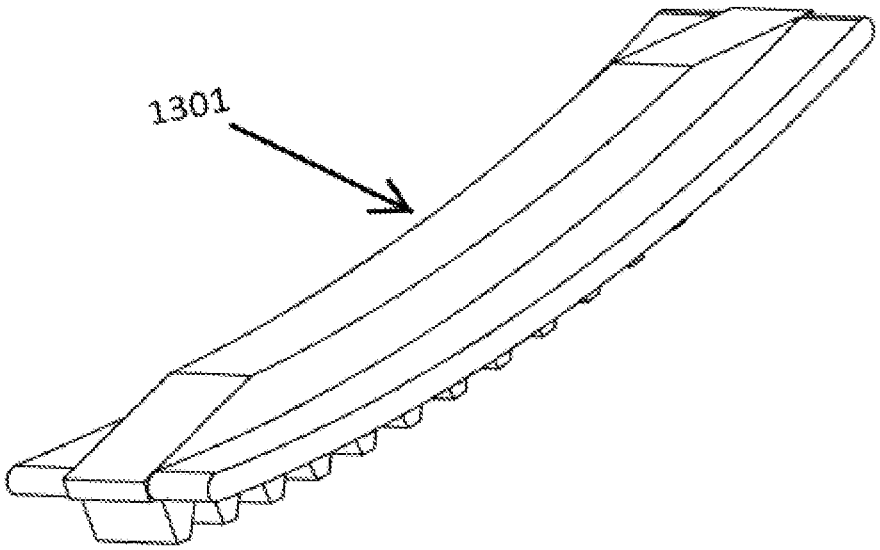
FIG. 13 shows a bowed rack according to an alternative embodiment of an automation device consistent with the disclosure hereof adapted for a rocker-type switch.

In an alternative embodiment of an automation device configured to control and/or operate a rocker type switch fixture, the rotational head 1101 shown in FIG. 11 may be replaced with a curved or bowed rack driven by a pinion in a rack and pinion mechanism functionally operating in a similar fashion to the rack and pinion mechanism of the example embodiment of the automation device depicted in FIGS. 5 and 6. Referring now to FIG. 13, an example embodiment of such a curvilinear or bowed rack is shown having pinion matching teeth on a side opposite from that of the direction of the bow. In this alternative embodiment, which is to be used with a rocker switch as has been described, the curved or bowed rack 1301 is moved by a toothed or geared pinion such that ends of the curved or bowed rack 1301 contact the lever of the rocker switch in order to toggle the rocker switch between an on and off state.

Figure 14:
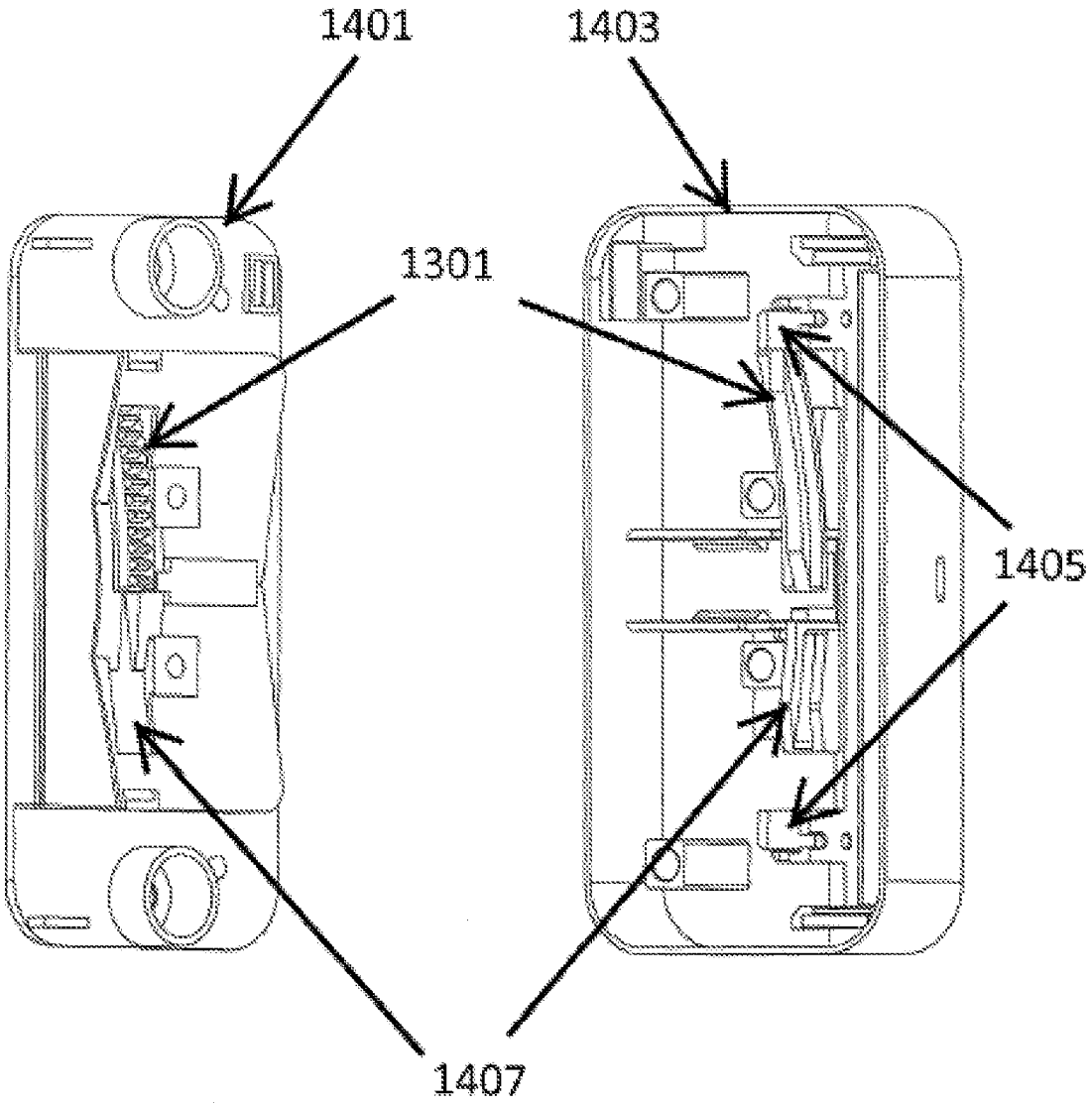
FIG. 14 shows the bowed rack and housing configuration according to an alternative embodiment of an automation device consistent with the disclosure hereof adapted for a rocker-type switch.

This operation can more readily be seen in FIG. 14 where front portion 1403 and back portion 1401 of the automation device housing, which when combined contains or holds the bowed rack 1301, can be seen. In particular, the pinion moves the bowed rack 1301, along and between curvilinear guides 1407 of front portion 1403 and back portion 1401 of the automation device housing, thereby causing ends of the bowed rack 1301 to extend in a rearward direction from the automation device housing and towards the lever of the rocker switch. Moving the bowed rack 1301 in one direction thus causes one end to flip the lever of the rocker switch into an "on" state and moving the bowed rack 1301 in the opposite direction thus causes an opposite end to flip the lever of the rocker switch into an "off" state.

Further, as also shown in FIG. 14, this example embodiment of the automation device includes limit switches 1405 which are contacted by the ends of bowed rack 1301 as bowed rack 1301 is moved between these two positions or states. The limit switches 1405 are coupled to the microcontroller 502 in order to send a signal to microcontroller 502 when one end of bowed rack 1301 contacts one of the limit switches 1405 thereby informing microcontroller 502 that the bowed rack 1301 has reached an end position (equivalent to the 0° position or 180° position described above with reference to a toggle-type embodiment of the automation device). Upon receipt of this signal, the microcontroller 502 directs that the pinion stop moving bowed rack 1301 in its current direction and, instead, briefly reverse its direction in order to return bowed rack 1301 to an offset position from the end position, to achieve the same effect as was described above with reference to a toggle-type embodiment of the automation device.

It is to be understood that other embodiments of an automation device, such as embodiments configured to control and/or operate a toggle-type switch fixture, can likewise incorporate limit switches similar to the limit switch 1405 shown in FIG. 14, to be contacted by a portion of an actuator such as, for example, the ends of rack 405 of the linear actuator shown in FIG. 5, to thereby operate in essentially the same fashion as described above with reference to an alternative rocker-type embodiment of the automation device.

In a still further embodiment of an automation device the servomechanism portion of the actuator mechanism can be replaced by a direct current (DC) motor to drive the pinion of a rack and pinion mechanism. This DC motor based arrangement, while functionally similar to that of the servomechanism based arrangement, can be used in conjunction with limit switches such as, for example, the limit switches 1405 shown in FIG. 14, as will now be described. When the automation device is powered on (e.g., via toggle switch 407), the DC motor directs the pinion to move the rack until one of the limit switches sends a signal to the microcontroller that the rack has made contact with it. Then the microcontroller directs the DC motor to reverse direction for a predetermined period of time, based on the known revolutions per minute (RPM) of the DC motor, to cause the rack to be placed in a neutral or center position of the automation device. This places the rack opening, bowed rack, or other actuator component of the automation device, in a middle or intermediate position most easily placed by a user over the lever of the light switch without unintentionally flipping the light switch. The user is instructed to place the automation device on the light switch in an up position (as may be indicated by a visual marker on the automation device) after this power up sequence. Thereafter, any command received by the microcontroller 502 to either flip the switch on or off results in the microcontroller signaling the DC motor to cause the pinion to move the rack in the appropriate direction (e.g., up for on and down for off) until one of the limit switches 1405 signals the microcontroller 502 that the rack has made contact with it, thereby indicating that the rack has reached an end position, at which point the microcontroller signals the DC motor to reverse direction for a brief period of time thereby placing the rack in the offset position, as was described above. It is to be understood that mechanisms such as solenoids, stepper motors and Shape Memory Alloys (SMAs) can likewise be used in place of the DC motor.

In a further example embodiment, a time out operation is used with the above-described process to prevent possible damage to components of the automation device as well as achieve potential power savings. For example, with some physically large light switch levers, the rack may not be able to move far enough to contact one of the limit switches despite already having moved far enough to flip the light switch. Not receiving an end position signal from a limit switch could cause the microcontroller to continue directing the DC motor to move the pinion until either the DC motor burns out or the rack and pinion mechanism breaks and also continues to consume power running the DC motor. This is avoided in this further embodiment where, starting from the intermediate power up position, the microcontroller stops signaling the DC motor to cause the pinion to move the rack upon either receiving the limit switch signal or a first time out period has elapsed, whichever occurs first. The first time out period would typically be the amount of time, again based on the known RPMs of the DC motor, expected to move the rack from the intermediate position to the end position. A second time out period, approximately twice as long as the first time out period because the rack's length of travel is approximately twice as long when going from one end position (or the offset position) to the other end position, would then be used for any later switching operations between the on and off states of the light switch.

In a further alternative embodiment, one or more additional sensors are included within the automation device to detect presence of a user. Any known sensor can be used including a motion sensor, a temperature sensor, a humidity sensor, a camera, etc. Such sensor can then signal to the microcontroller that a user is present thereby causing the microcontroller to turn on the switch.

Also disclosed herein are embodiments of an automation device for installation on and/or controlling an electric receptacle. In embodiments as illustrated schematically in FIG. 19, there is provided an automation device 1900 for installation over an existing electrical receptacle 1901, the automation device including a housing 1915, a plurality of electrically conductive male prongs 1905 extending outward from the housing and disposed in an arrangement compatible for insertion into a plurality of plug recesses of the electrical receptacle so as to make electrical contact with the electrical contacts 1903 of the receptacle; at least one female electrical receptacle subassembly 1906 comprising a plurality of conductive contacts 1913 disposed in recesses in an arrangement compatible with a male electrical plug; a regulator 1907 adapted to regulate an electrical connection 1914 between at least one of the electrically conductive male prongs and at least one of the conductive contacts; and a controller 1908 communicating 1918 with the regulator and adapted and configured to control the regulator in response to a signal and/or according to a program or logic. The automation device may be installed on the electrical receptacle by inserting the male prongs of the automation device into the female plug recesses of the electrical receptacle. As with other embodiments of automation devices disclosed herein, in some embodiments, the automation device may be secured in whole or part to the electric receptacle or a cover plate 1902 thereof by a self-affixing attachment, which may, in embodiments, be implemented in whole or part by one or more self-affixing fasteners and/or one or more releasable fasteners.

In some embodiments, an electrical receptacle has a cover plate 1902 secured by one or more ferrous metal screws 1916, and the housing 1915 of an automation device may be provided with rear-facing magnetic material 1909 in at least one location corresponding to a cover plate screw 1916; the attractive force of the rear-facing magnetic material toward the screw head of the cover plate screw of the electrical receptacle improves the stability of the installation, a particularly useful feature in installations where, as often occurs, the contacts of the existing electrical receptacle are bent, worn, or otherwise not in optimal condition for gripping the male prongs of the automation device, resulting in a tendency for male plugs to dislodge or fall out of the receptacle. In an embodiment, it is not necessary that all of the male prongs be conductive or be connected to the regulator; since all that is required is a power source and assuming both or all receptacle subunits are supplied from the same power source, for all but one male subassembly plastic or other nonconductive and/or non-connected prongs may be substituted, thereby reducing the cost of the device, and reducing unnecessary internal complexity.

In an example embodiment of an electric receptacle automation device, the female electrical receptacle subassembly 1906 is adapted and configured to receive a male electrical plug, which may include any of the many male electrical plug configurations compatible with home, office or other electrical systems; in embodiments, it may be found preferable to employ a female electrical receptacle subassembly configuration compatible with a male electrical plug configuration of a type commonly used in and compliant with relevant electrical codes of the country and region where the device is intended to be used.

Figure 20:
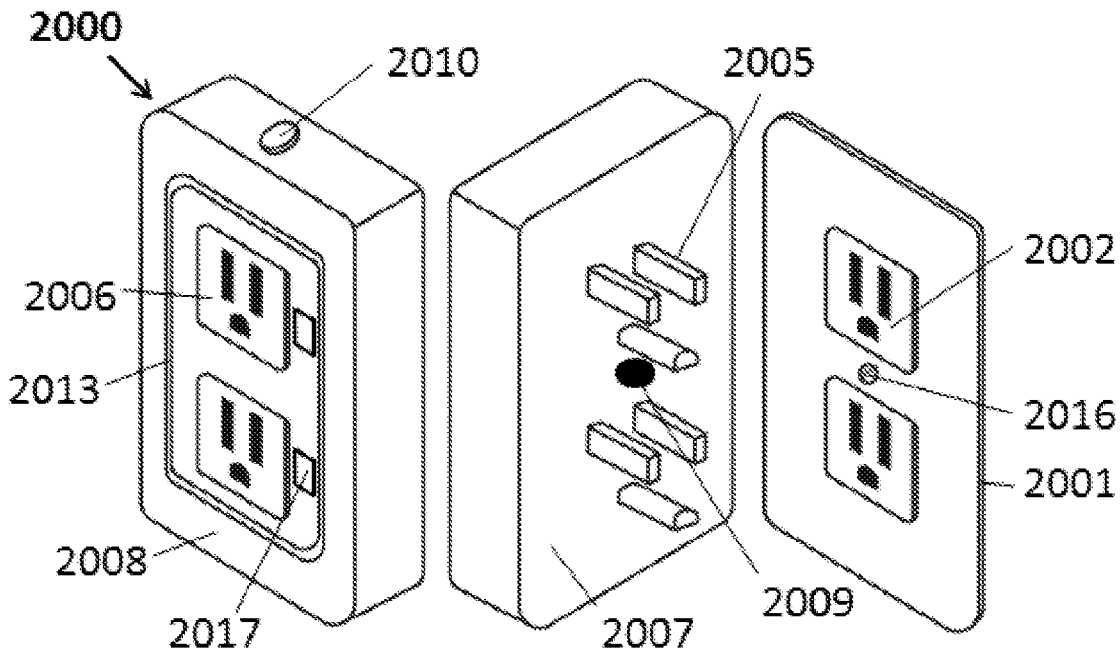
FIG. 20 depicts an embodiment of an automation device consistent with the disclosure hereof, adapted and configured for installation over an electric receptacle.

FIG. 20 illustrates an example embodiment 2000 showing a typical physical layout and form factor. The male prongs of the device 2005 are configured to plug into an existing receptacle fixture 2002 having a cover plate 2001 secured by a metallic screw 2016. The male prongs extend outward from the back portion 2007 of the housing of the device (that is, the portion adjacent to the existing receptacle fixture when the device is installed onto the fixture), and a magnetic material 2009 is disposed in a position for alignment with the cover plate screw 2016 of the receptacle fixture. The female electrical receptacle subassemblies 2006 of the device are accessible in the front portion 2008 of the device (that is, the portion facing outward when the device is installed over a fixture). Optionally, as with other automation devices and embodiments thereof disclosed herein, a luminescent strip 2013 may be provided to improve the visibility of the device under low light conditions, and a motion, ambient light, or other sensor 2110 may be incorporated. In embodiments, a device may incorporate user controls, such as, for example, a button 2017 for individually activating and/or deactivating a female electrical receptacle subassembly.

Figure 19:
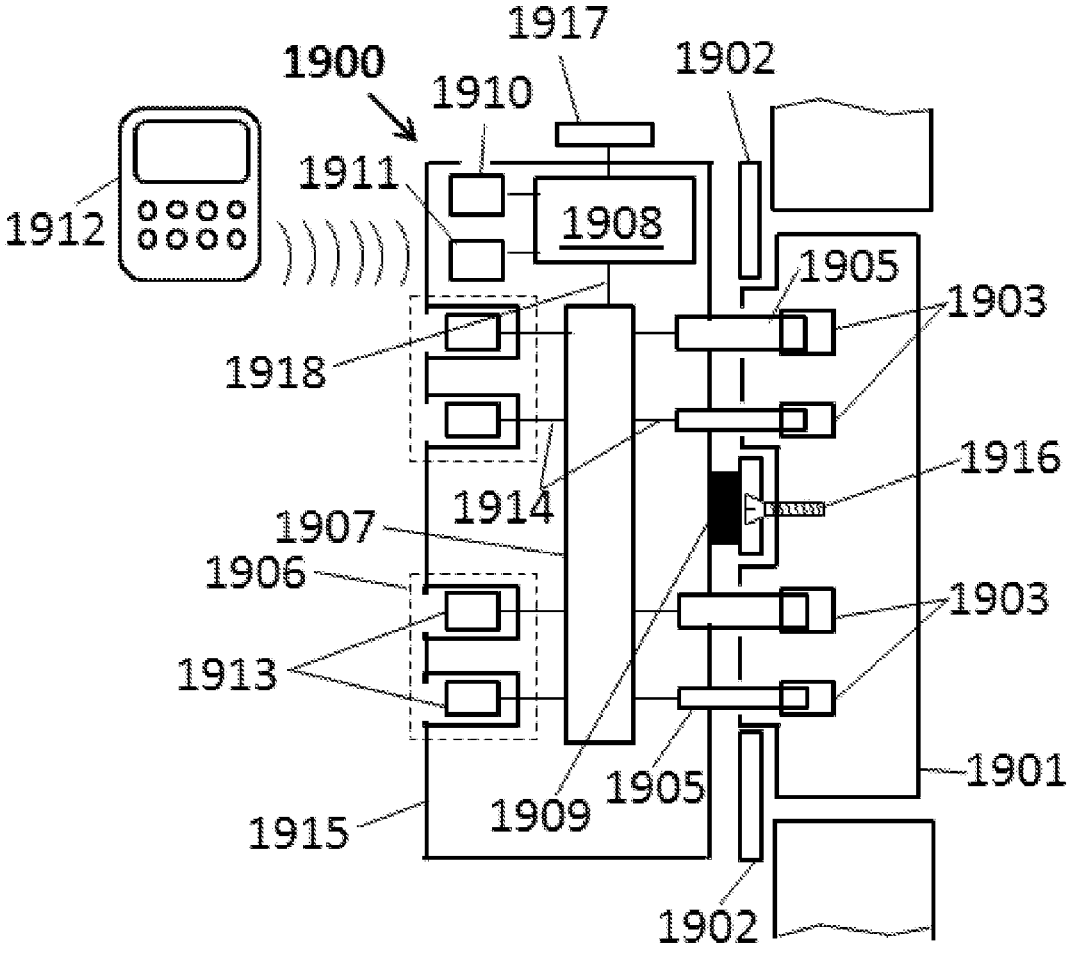
FIG. 19 depicts schematically an embodiment of an automation device consistent with the disclosure hereof, adapted and configured for installation over an electric receptacle.

In embodiments as illustrated in FIG. 19, an electric receptacle automation device is provided with a regulator 1907, for regulating a connection 1914 between the contacts 1903 of the receptacle and the contacts 1913 of the female electrical receptacle subassembly. The regulator may control, regulate, and/or modify the electrical current and/or potential delivered by the receptacle in any manner found useful for an application of interest, and may do so using any of the many components and circuits familiar to persons of skill in the art of electrical and electronic engineering and design. By way of example, in embodiments, the regulation of the connection may be passive, such as by a switch or relay to make or break the connection, thereby delivering or disconnecting the current and/or potential of the receptacle to the female electrical receptacle subassembly and thereby, for example, controlling an appliance plugged into the female electrical receptacle subassembly to an "on" or "off" state. In some embodiments, the regulator may operate to deliver to the female electrical receptacle subassembly current and/or potential differing from that present at the contacts of the receptacle, such as, for example, by providing for controllably reduced potential at the female electrical receptacle subassembly, thereby providing "dimmer" type functionality, or by altering the frequency and/or waveform of the delivered current so as to provide motor speed control functionality, or by filtering the delivered current to remove spikes or noise.

In embodiments, an electrical receptacle automation device may include a controller 1908 in communication via a communication channel 1918 with a regulator 1907, the controller being adapted and configured to control the operation of the regulator. As with other automation devices as disclosed herein, a controller of a receptacle automation device may, in some embodiments, be configured to respond to any inputs and/or signals deemed useful for an application of interest, such as, for example, any one or more of a signal electrically communicated from one or more buttons or other user controls 1917 incorporated into the automation device, a signal communicated wirelessly from a remote device 1912 to a receiver 1911 in communication with the controller, a signal communicated to the controller from a sensor 1910 such as a motion sensor or light sensor. In embodiments, an automation device may be provided with additional sensors and/or communication components for any useful purpose, such as, for example one or more sensors, transmitters, and/or local or remote user interfaces or displays to provide communication of device status to a user and/or to a remote system for controlling one or more devices. As with other automation devices as disclosed herein, in embodiments, optionally there may also be provided one or more wireless devices for communicating with other automation devices and/or with a central controller and/or one or more user interface devices. Thus in various embodiments, as with any of the automation devices disclosed herein, a receptacle automation device may include a Bluetooth or other wireless transceiver and one or more sensors such as a motion sensor and/or light sensor, the controller of the device being programmed and/or embodying logic to perform functions such as, for example, triggering another automation device, or sensing motion and/or sensing an ambient light level and in response thereto turning on a night light or other illumination component that may be included as part of the device. In some embodiments, an automation device may include a proximity sensor in communication with the controller and/or wireless transceiver, thereby providing functionality such as notifying the system and/or a controller thereof or related device or system (such as an intrusion alarm system) of the presence of a person, pet, or other entity detectable by the proximity detector. In some embodiments, an automation device may include one or more environmental sensors, such as, for example temperature sensors and/or humidity sensors, and be configured to communicate environmental data to other automation devices, and/or a central system and/or controller, and/or other systems such as HVAC and/or humidifier systems. In some embodiments, an automation device may include one or more sound sensors, thereby enabling functionality such as, for example, communicating with a sound or entertainment system to regulate sound volume levels, and/or may incorporate sound sensors coupled with voice recognition functionality, thereby enabling voice control of the automation devices and/or other devices or systems in communication with the automation device. In embodiments, an automation device according to the disclosure hereof may, in addition to or in lieu of its local function of controlling a light switch, receptacle, or other fixture, also function as a "sensor platform" for communicating with, controlling, and/or reporting and/or processing status information to or from one or more other automation devices or control, interface, or reporting devices.

Figure 21:
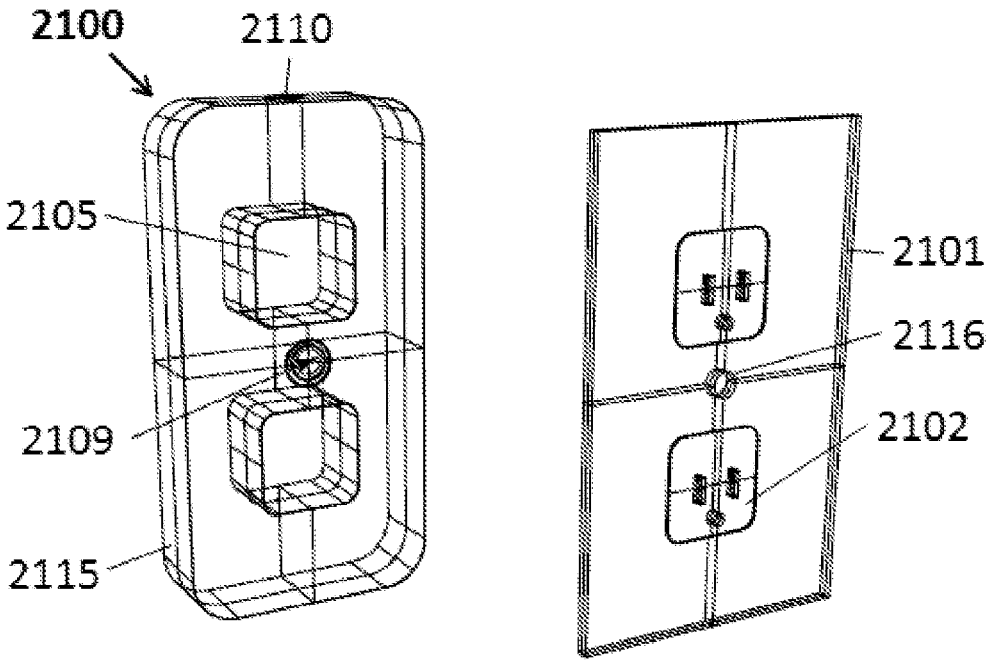
FIG. 21 depicts an embodiment of an automation device consistent with the disclosure hereof, adapted and configured for installation over an electric receptacle while maintaining accessibility of the receptacle.

In some embodiments of an automation device for installation over an electrical receptacle, the functionality of regulating the output of the receptacle may not be needed, and one or more of the corresponding components (i.e. the male prongs, the female electrical receptacle subassemblies, and the regulator) may be omitted, or a female electrical receptacle subassembly may be directly connected to the corresponding male prongs, while nevertheless retaining any of the other functionality, such as, for example, the sensor, control, wireless communication, and "sensor platform" functionality described. In such embodiments it may also be found useful, as illustrated in FIG. 21, to provide an aperture 2105 extending entirely through the housing 2115 of the device 2100, so that the plug receiving portions 2102 of the existing receptacle remain accessible for use by inserting the plug of an electrical appliance through the aperture and into the receptacle, without disturbing or unmounting the automation device. The automation device may retain any of the other disclosed functionality and/or components, such as, for example, one or more sensors 2110; as in other examples, the device may be held in place by magnetic material 2109 disposed in the portion of the device adjacent to a metallic screw 2116 securing the receptacle cover plate 2001, and/or any other attachment modality as disclosed herein.

Thus in embodiments there is provided an automation device for installation over an electrical receptacle having a cover plate secured thereto by at least one ferrous metal cover plate screw, the automation device including: a self-aligning housing having rear-facing magnetic material in at least one location corresponding to the cover plate screw, and having at least one aperture extending through the housing to provide access permitting inserting of an electrical plug into the receptacle; at least one sensor; and a wireless communication device for communicating from the automation device a signal encoding information derived from the at least one sensor. In embodiments, an aperture 2105 may be fully surrounded by portions of the housing as depicted in FIG. 21; in other embodiments, an aperture could be partially surrounded, and open on one or more sides (i.e. "C"-shaped), or may take any desired form provided that sufficient space is provided to allow access for inserting at least one electrical plug into the receptacle. A sensor may be of any type found useful for an application of interest, and of any design, composition, and/or construction. A wireless communication device may include a transmitter, receiver, or transceiver of any type or protocol operable to transmit or receive a signal to or from another device. In embodiments, output from a sensor may be routed directly to a wireless communication device, or may be routed to a controller or other component for processing and from the controller or other component to the wireless communication device. In embodiments where sensor input is not needed, the sensor could be omitted and an automation device could serve as a central hub or controller for controlling and operating other devices in an automation system.

Any of the automation devices disclosed herein may be configured and arranged in any configuration and arrangement found useful for an application of interest, and as may be convenient for compatibility with the variety of fixture designs in existence or that may appear in the future. Thus, for example, automation devices may be configured for multi-gang receptacles, switches, and/or other fixtures, such as, for example, by integrating two or more light switch actuators, or one, two, or more receptacle interfaces, or any combination thereof in a single device, by configuring devices so as to be dimensionally compatible for side-by-side installation over fixtures exposing two or more controls, or in any other manner providing a desired arrangement of components and functionality.

Other Embodiments

In embodiments, disclosed herein is a light switch automation device including a housing and provided with a self-affixing releasable attachment for affixing the housing in position over the light switch, an actuator located within the housing, the actuator configured to actuate a lever of the light switch once the light switch automation device has been placed on the light switch cover plate, and a microcontroller located within the housing, the microcontroller configured to control the actuator. In an embodiment, an actuator may include any device or component or combination thereof operable to impart a desired force or motion to a switch lever or other element, and may, as indicated by context, include one or more components configured to engage another element and/or apply a force or motion thereto, one or more components for producing a force or motion such as, for example, a motor, a servo, a solenoid, or a hydraulic or pneumatic piston, and/or for transmitting a force or motion and/or converting a force or motion to another form or direction, such as, for example, a transmission, gear drive, chain and sprocket, rack and pinion, push-rod, lever, or rotor.

In embodiments, the housing of a switch automation device, receptacle automation device, or other automation device according to the disclosure hereof, may be of any geometry and composition compatible with an application of interest; it may be found useful to employ a housing of approximately the size and shape of a fixture to which an automation device is to be installed, and to minimize the overall thickness of the automation device to the extent feasible so as to reduce the outward or downward dislodging force produced as a result of the weight of the device. In embodiments, components may be disposed within a housing or otherwise mounted on or in association with a housing in any operable arrangement. Although it will usually be found convenient to employ a microcontroller to control the actuator, regulator, and/or other elements of an automation device, any device or component or combination thereof operable to control elements in a desired manner may be employed in addition to or in lieu of a microcontroller, such as, for example, an electronic circuit or a custom control module. Any such components may, in embodiments, be provided as separate components or may be integrated or combined in any operable manner.

In embodiments, an automation device may be affixable over a fixture and/or cover plate without modification, removal, or disassembly of the fixture or cover plate. In embodiments, a self-affixing releasable attachment for installing an automation device over a light switch fixture, receptacle fixture, or other fixture may include at least one fastener selected from a hook and loop fastener, a magnet, an adhesive strip, a micro suction cup pad, a silicone adhesive pad, a double-sided adhesive tape, a 3M command tape, a spring clip, a gripping clip, an edge clasping retainer, an adhesive clay, and a removable adhesive. In embodiments, a light switch automation device, receptacle automation device, or other automation device according to the disclosure hereof may be installable over a light switch and cover plate or other fixture having a cover plate by placing the automation device in position over the fixture and cover plate, with no preparation or alteration of the fixture or cover plate required and no other installation required. In some embodiments, a light switch automation device, receptacle automation device, or other automation device according to the disclosure hereof may be installable over a fixture and cover plate by placing the automation device in position over the fixture and cover plate and pressing the automation device against the fixture and cover plate, again with no preparation or alteration of the light switch or cover plate required and no other installation required. In some embodiments, a light switch automation device, receptacle automation device, or other automation device according to the disclosure hereof is releasable from a fixture and cover plate to which it has been installed by applying a force to the light switch automation device in a direction outward from the light switch and cover plate, with no other de-installation steps required.

In some embodiments, a light switch automation device may be configured to engage a toggle-type lever of a light switch. In some embodiments, a light switch automation device may be configured to engage a rocker-type lever of a light switch. In some embodiments, a light switch automation device may be configured to engage a rocker-type lever of a light switch and may also include a second actuator configured to engage a slider-type dimmer control of the light switch. More generally, in embodiments, an automation device may be configured to engage a switch or other fixture having any type of lever or other physically operable control, and may additionally be provided with any number of actuators, optionally controlled by one or more additional controllers, for engaging, operating, and/or controlling any other physically operable elements(s) exposed by the switch or other fixture.

In embodiments, a light switch automation device, receptacle automation device, or other automation device according to the disclosure hereof may include a user input component, which may be coupled to the microcontroller to signal to the microcontroller to control an actuator, regulator, wireless transceiver, or any other component. In embodiments, a user input component may include any component or combination of components operable to produce or modify a signal in response to an action by a user, such as, for example, a mechanical push button, a lever, a keypad, a touch pad, or a capacitance or other electronical or optical sensor for detecting a user action.

In embodiments, a light switch automation device, receptacle automation device, or other automation device according to the disclosure hereof may include one or more friction pads, which may be disposed on an outer surface of the housing, such as for example on the back plate of the automation device. In embodiments, one or more friction pads may be disposed in or on any part of an automation device, in any position(s) and/or arrangement found useful for improving the stability of the device once installed over a switch fixture, electric receptacle, or other fixture. In embodiments, a light switch automation device, receptacle automation device, or other automation device according to the disclosure hereof may include a barrier adapted and configured to restrain the automation device against translational movement parallel to the surface of the cover plate of a fixture once the automation device has been installed over the fixture and cover plate, such as, for example, by impinging against an edge of the cover plate.

In embodiments, a light switch automation device, receptacle automation device, or other automation device according to the disclosure hereof may include a motion sensor and/or a light sensor, each connected to a microcontroller or other controller of the automation device by a communication channel. In embodiments, a microcontroller or other controller may be programmed or programmable to control an actuator, regulator, or any other controllable component of the automation device to perform an operation in response to or conditional upon a signal from the motion sensor and/or light sensor. In embodiments, in a similar manner, sensors of any type found useful for an application of interest may be incorporated in an automation device and placed in communication with a microcontroller or other controller of the device, which may be programmed or programmable to respond and/or control other components of the device in any manner found useful.

In embodiments, a light switch automation device, receptacle automation device, or other automation device according to the disclosure hereof may include a wireless communication module located within the housing or otherwise in association with the device. In embodiments, the wireless communication module may be configured to wirelessly receive a signal and communicate the received signal to a controller or respond thereto with any other action found useful in an application of interest. In embodiments a wireless communication module may be configured to wirelessly receive and/or transmit signals to and/or from one or more external devices, such as, for example, a wireless device, an infrared device, a Bluetooth device, a Wi-Fi device, a smart phone, a tablet computer, or a personal computer. In embodiments, a wireless communication module may operate using any protocol or encoding. In embodiments, a wireless communication module may include a plurality of components configured to act together perform the intended functionality, which may but need not necessarily be physically located together.

In embodiments, there is provided a method of controlling a fixture that exposes a physically operable control, the method including: with an automation device including an actuator and affixed by a self-affixing attachment to the fixture in position for engagement by the actuator with the physically operable control of the fixture, receiving a signal; and in response thereto controlling the actuator to operate the physically operable control. In embodiments, a signal may be of any type, source, and/or content, such as, for example, from a user input component incorporated in the automation device, an external control device, or a preprogrammed signal originating from a microcontroller or other controller of the device.

In embodiments, there is provided a method of installing on a fixture that exposes a physically operable control an automation device including an actuator, the method including: positioning the automation device in contact with the fixture with the actuator in engagement with the physically operable control, and attaching the automation device to the fixture by a self-affixing attachment.

In embodiments, there is provided an automation device for engagement with a fixture having a physically operable control, the automation device including an attachment for attaching the automation device to the fixture, an actuator for engaging the physically operable control and performing at least one operation thereon, and a controller configured to communicate with the actuator and control an operation thereof. In embodiments, the components of the automation device may be disposed in a housing or other assembly of any kind found useful for disposing and maintaining them in a desired arrangement. In embodiments, the attachment may include a self-affixing fastener or attachment. In embodiments, the attachment may be a releasable attachment and/or the automation device may be releasably installable on the fixture. In embodiments, an automation device may be adapted and configured for modification-free installation on a fixture; that is, capable of being installed without any need for alteration, complete or partial dismantling, or other modification of the fixture.

In embodiments, there is provided a light switch automation device for controlling a light switch that includes a switch lever and a dimmer control, the light switch automation device including: a self-aligning housing having rear-facing magnetic material in locations corresponding to metallic screw heads of a cover plate of the light switch; a first actuator located within the housing, the first actuator configured to actuate the switch lever of the light switch once the light switch automation device has been placed on the light switch cover plate; a second actuator configured to actuate the dimmer control; and a microcontroller located within the housing, the microcontroller configured to control the actuator.

In embodiments, there is provided a light switch automation device including: a self-aligning housing having rear-facing magnetic material in locations corresponding to metallic screw heads of a cover plate for a light switch; an actuator located within the housing, the actuator configured to actuate a lever of the light switch once the light switch automation device has been placed on the light switch cover plate; a microcontroller located within the housing, the microcontroller configured to control the actuator; and one or more sensors configured to communicate a signal to the microcontroller. In embodiments, a sensor may include a motion sensor, a light sensor, or any other sensor found useful for an application of interest.

In embodiments, there is provided a system for controlling a plurality of user-controllable fixtures, the system including: a plurality of automation devices each adapted and configured for installation to a fixture, in engagement with a physically operable control, if any, of the fixture; and a control device configured to communicate at least one signal to each of the automation devices. In embodiments, a control device may be pre-programmed, user programmable, and/or controllable by real time or other inputs, or in any other manner. In embodiments, a control device may be incorporated into an automation device, or may include a separate device, such as, for example, a wireless device, an infrared device, a Bluetooth device, a Wi-Fi device, a smart phone, a tablet computer, or a personal computer. In embodiments, installation to a fixture may include self-affixing attachment of an automation device to a fixture or portion thereof. In embodiments, installation to a fixture may include releasable attachment of an automation device to a fixture or portion thereof. In embodiments, at least one automation device of the system may be installable without any need for alteration, complete or partial disassembly, or other modification of the fixture to which it is installed. In embodiments, a system for controlling a plurality of fixtures may include one or more light switch automation devices, one or more electrical receptacle automation devices, one or more other automation devices according to the disclosure hereof, or any combination of the foregoing.

In embodiments, there is provided an electrical receptacle automation device for installation over an electrical receptacle having a cover plate secured thereto by at least one ferrous metal cover plate screw, the automation device comprising a self-aligning housing having rear-facing magnetic material in at least one location corresponding to a cover plate screw of the electrical receptacle, a plurality of electrically conductive male prongs extending outward from the housing and disposed in an arrangement compatible for insertion into a plurality of plug recesses of the electrical receptacle, at least one female electrical receptacle subassembly comprising a plurality of conductive contacts disposed in recesses in an arrangement compatible with a male electrical plug, a regulator adapted to regulate an electrical connection between at least one of the electrically conductive male prongs and at least one of the conductive contacts, and a controller configured to control the regulator in response to a signal.

In embodiments, there is provided a method of controlling the output of an electrical receptacle, the method including: with an electrical receptacle automation device according to the disclosure hereof, affixed by a self-affixing attachment to the fixture in position for engagement with the receptacle, receiving a signal; and in response thereto controlling the output of a female electrical receptacle subassembly of the automation device. In embodiments, a signal may be of any type, source, and/or content, such as, for example, from a user input component incorporated in the automation device, an external control device, or a pre-programmed signal originating from a microcontroller or other controller of the device.

In embodiments, there is provided a method of installing on an electrical receptacle fixture an automation device according to the disclosure hereof, the method including: positioning the automation device in engagement with the receptacle and attaching the automation device to the fixture by a self-affixing attachment.

CONCLUDING MATTER

The disclosed methods, systems, devices, apparatus, compositions, articles of manufacture, and improvements thereof have been explained above with reference to several embodiments. Other embodiments will be apparent to those skilled in the art in light of this disclosure. Certain aspects of the described subject matter may readily be implemented using configurations other than those described in the embodiments above, or in conjunction with elements other than those described above. For example, different components, algorithms and/or logic circuits, perhaps more complex than those described herein, may be used. Further, as would be understood by one of skill in the art in light of the description herein, use of a switch automation device is not limited to controlling a pre-existing switch electrically coupled to a light fixture; an automation device can also control a pre-existing switch electrically coupled to any electrical apparatus or component. As such, any reference herein to an automation device being a light switch automation device or to the pre-existing switch being a light switch should not be interpreted to limit use with a switch electrically coupled to a light fixture. Further, although many of the examples and embodiments described herein relate to automation devices for controlling and/or operating light switch fixtures, the disclosed principles, methods, and components may be readily adapted to any user controllable fixtures having physically operable controls or user-operable controls or that otherwise are intended or adapted to interact with or supply power or signals to devices or appliances of any kind.

Further, it should also be appreciated that the described subject matter can be implemented in numerous ways, including as a process, an apparatus, or a system. The methods described herein may be implemented by program instructions for instructing a processor to perform such methods, and such instructions recorded on a non-transitory computer readable storage medium such as a hard disk drive, floppy disk, optical disc such as a compact disc (CD) or digital versatile disc (DVD), flash memory, etc., or communicated over a computer network wherein the program instructions are sent over optical or electronic communication links. It should be noted that the order of the steps of the methods described herein may be altered and still be within the scope of the disclosure.

It is to be understood that the examples given are for illustrative purposes only and may be extended to other implementations and embodiments with different conventions and techniques. While a number of embodiments are described, there is no intent to limit the disclosure to the embodiment(s) disclosed herein. On the contrary, the intent is to cover all alternatives, modifications, and equivalents apparent to those familiar with the art.

In the foregoing specification, the disclosed subject matter is described with reference to specific embodiments thereof, but those skilled in the art will recognize that the invention is not limited thereto. Various features and aspects of the above-described subject matter may be used individually or jointly. Further, the described subject matter can be utilized in any number of environments and applications beyond those described herein without departing from the broader spirit and scope of the specification. The specification and drawings are, accordingly, to be regarded as illustrative rather than restrictive. It will be recognized that the terms "comprising," "including," and "having," as used herein, are specifically intended to be read as open-ended terms of art.

Except as otherwise explicitly stated, an embodiment of an apparatus or object is described herein in an orientation as in normal use as described herein, with "lower side" referring to the portion generally oriented downward, and "upper side" referring to the generally upwardly oriented portion. "Upward" and "downward" refer to the upward and downward directions relative to the apparatus or object when oriented as in normal use. "Lateral" and "horizontal" refer to the spatial dimensions generally perpendicular to the "upward" and "downward" directions, with the apparatus or object oriented as in normal use. "Vertical" refers to the generally upward/downward direction with the apparatus or object oriented as in normal use. "Inward" and "outward" refer respectively to lateral directions generally toward and away from generally vertical axis passing through the centroid or center of mass of the apparatus or object. Except as otherwise specifically stated or required by context, directional terms are not intended to be limiting or to imply that the apparatus or object must be used in any particular position or orientation.

In embodiments, components and/or substructures described herein as having fixed positions relative one to another may be held in position in any manner operable to maintain the specified positions under conditions of normal use as described herein, such as, by way of example only, by the use of mechanical fasteners such as bolts, screws, nuts, or rivets; by heat, such as, for example, welding, brazing, or soldering; by an adhesive; by incremental deposition, such as, for example, by 3D printing; and/or by forming a component integrally or as a single piece with another component. In embodiments, components and/or substructures described herein as having movable positions relative one to another may be constrained in position in any manner operable to constrain the components and/or substructures within the specified ranges of positions under conditions of normal use as described herein, such as, by way of example only, by the use of mechanical fasteners such as hinges, sliders, tracks, followers, pivots, bearings, and/or flexible components. Unless otherwise specifically stated or required by context, mounting and/or affixation may be permanent or removable or removable and replaceable, as deemed useful for an application of interest.

For clarity and to ensure completeness, certain of the aspects and/or embodiments disclosed herein may be overlapping in scope, described repetitively, or represent recitals of the same or equivalent elements or combinations expressed in alternative language. It will be apparent that the choice of particular phraseology and/or of particular aspects or elements to assert as claims involves many complex technical and legal considerations, and no inference should be drawn that alternative descriptions of a particular element or combination in this written description necessarily do or do not encompass different subject matter; except where context otherwise requires, each described aspect or element should be interpreted according to its own description.

It is intended that this specification be interpreted in accordance with the normal principles of English grammar and that words and phrases be given their ordinary English meaning as understood by persons of skill in the pertinent arts except as otherwise explicitly stated. If a word, term, or phrase is intended to be further characterized, specified, or narrowed in some way, then additional adjectives, modifiers, or descriptive text have been included in accordance with the normal principles of English grammar. It is intended that the meanings of words, terms, or phrases should not be modified or characterized in a manner differing from their ordinary English meaning as understood by persons of skill in the relevant arts except on the basis of adjectives, modifiers, or descriptive text that is explicitly present.

Except as otherwise explicitly stated, terms used in this specification, including terms used in the claims and drawings, are intended as "open" terms. That is, for example, the words "including" and "comprising" should be interpreted to mean "including but not limited to," the word "having" should be interpreted to mean "having at least," the word "includes" should be interpreted to mean "includes but is not limited to," the phrases "for example" or "including by way of example" should be interpreted as signifying that the example(s) given are non-exhaustive and other examples could be given, and other similar words and phrases should be given similar non-exclusive meanings. Except as explicitly stated, ordinals used as adjectives (e.g. "first object", "second object", etc.) in this specification, including claims and drawing figures, are intended merely to differentiate and do not imply that any particular ordering is required. Thus, for example, unless otherwise explicitly stated, "first measurement" and "second measurement" do not imply that the first measurement necessarily takes place before the second measurement, but merely that they are distinct measurements.

In the written description and appended claims, the indefinite articles "a" and/or "an" are intended to mean "at least one" or "one or more" except where expressly stated otherwise or where the enabling disclosure requires otherwise. The word "or" as used herein is intended to mean "and/or", except where it is expressly accompanied by the word "either", as in "either A or B". Applicants are aware of the provisions of 35 U.S.C. §112, ¶6. The use of the words "function," "means" or "step" in the written description, drawings, or claims herein is not intended to invoke the provisions of 35 U.S.C. §112, ¶6, to define the invention. To the contrary, if the provisions of 35 U.S.C. §112, ¶6 are sought to be invoked, the claims will expressly include one of the exact phrases "means for performing the function of" or "step for performing the function of". Moreover, even if the provisions of 35 U.S.C. §112, ¶6 are explicitly invoked to define a claimed invention, it is intended that the claims not be limited only to the specific structure, material or acts that are described in the preferred embodiments, but in addition, extend to any and all structures, materials or acts that perform the claimed function as described in alternative embodiments or forms of the invention, or that are well known present or later-developed equivalent structures, material or acts for performing the claimed function.

Any of the methods of the present disclosure may be implemented in whole or part in hardware, software, or both, or by a computer program, and may be carried out using any of the disclosed devices or apparatus according to any aspect or embodiment of the present invention, or in any other operable manner.

In the foregoing description, various details, specific aspects, embodiments, and examples have been described in order to illustrate and explain the subject matter, to provide a thorough understanding of the various aspects, to enable persons skilled in the pertinent arts to practice the described subject matter, and to disclose the best mode of doing so known to applicants. These details, specific aspects, embodiments, and examples are not intended to be limiting; rather, it will be apparent to persons of skill in the relevant arts that, based upon the teachings herein, various changes, substitutions, modifications, rearrangements, may be made and various aspects, components, or steps may be omitted or added, without departing from the subject matter described herein and its broader aspects. Except as otherwise expressly stated or where aspects or features are inherently mutually exclusive, aspects and features of any embodiment described herein may be combined with aspects and features of any one or more other embodiments. Titles, headings, and subheadings herein are intended merely as a convenience for locating content, and do not limit or otherwise affect the interpretation of the content of the disclosure. The appended claims are intended to encompass within their scope any and all changes, substitutions, modifications, rearrangements, combinations of aspects or features, additions, and omissions that are within the spirit and scope of the subject matter as described herein and/or within the knowledge of a person of skill in the art. The scope of the invention is defined by the claims, and is not limited by or to the particular embodiments or aspects chosen for detailed exposition in the foregoing description, but rather extends to all embodiments or aspects as defined by the claims, as well as any equivalents of such embodiments or aspects, whether currently known or developed in the future.

We claim:

1. A light switch automation device comprising: a housing comprising a self-affixing releasable attachment for affixing the housing in position over the light switch; an actuator located within the housing, the actuator configured to actuate a lever of the light switch once the light switch automation device has been placed on the light switch cover plate; and a microcontroller located within the housing, the microcontroller configured to control the actuator.

2. The light switch automation device of claim 1, wherein the light switch automation device is affixable over the light switch and light switch cover plate without modification, removal, or dissasembly of the light switch or cover plate.

3. The light switch automation device of claim 1, wherein the self-affixing releasable attachment comprises at least one fastener selected from a hook and loop fastener, a magnet, an adhesive strip, a micro suction cup pad, a silicone adhesive pad, a double-sided adhesive tape, a 3M command tape, a spring clip, a gripping clip, an edge clasping retainer, an adhesive clay, and a removable adhesive.

4. The light switch automation device of claim 1, wherein the light switch automation device is affixable over the light switch and cover plate by placing the light switch automation device in position over the light switch and cover plate.

5. The light switch automation device of claim 1, wherein the light switch automation device is affixable over the light switch and cover plate by placing the light switch automation device in position over the light switch and cover plate and pressing the light switch automation device against the light switch and cover plate.

6. The light switch automation device of claim 1, wherein the light switch automation device is releasable from the light switch and cover plate by applying a force to the light switch automation device in a direction outward from the light switch and cover plate.

7. The light switch automation device of claim 1, wherein the actuator is configured to engage a toggle-type lever of the light switch.

8. The light switch automation device of claim 1, wherein the actuator is configured to engage a rocker-type lever of the light switch.

9. The light switch automation device of claim 1, wherein the actuator is configured to engage a rocker-type lever of the light switch, and the light switch automation device further comprises a second actuator configured to engage a dimmer control of the light switch.

10. The light switch automation device of claim 1, further comprising a user input component coupled to the microcontroller to signal to the microcontroller to control the actuator.

11. The light switch automation device of claim 1, further comprising at least one friction pad disposed on an outer surface of the light switch automation device.

12. The light switch automation device of claim 1, further comprising a barrier for restraining the automation device against movement parallel to the surface of the light switch cover plate once the automation device has been installed over the light switch and light switch cover plate.

13. The light switch automation device of claim 1, further comprising a motion sensor connected to the microcontroller by a communication channel.

14. The light switch automation device of claim 13, wherein the microcontroller is programmed or programmable to control the actuator to perform an operation in response to or conditional upon a signal from the motion sensor.

15. The light switch automation device of claim 1, further comprising a light sensor connected to the microcontroller by a communication channel.

16. The light switch automation device of claim 15, wherein the microcontroller is programmed or programmable to control the actuator to perform an operation in response to or conditional upon a signal from the light sensor.

17. The light switch automation device of claim 1, further comprising a wireless communication module located within the housing, the wireless communication module configured to wirelessly receive a signal and communicate the received signal to the microcontroller.

18. The light switch automation device of claim 1, wherein the received signal comprises a signal from a control device selected from a wireless device, an infrared device, a Bluetooth device, a WiFi device, a smart phone, a tablet computer, and a personal computer.

19. A method of controlling a fixture comprising a physically operable control, the method comprising: with an automation device comprising an actuator and affixed by a self-affixing attachment to the fixture in position for engagement by the actuator with the physically operable control of the fixture, receiving a signal; and in response thereto controlling the actuator to operate the physically operable control.

20. A method of installing on a fixture comprising a physically operable control an automation device comprising an actuator, the method comprising: positioning the automation device in contact with the fixture with the actuator in engagement with the physically operable control, and attaching the automation device to the fixture by a self-affixing attachment.

21. An automation device for installation over an electrical receptacle having a cover plate secured thereto by at least one ferrous metal cover plate screw, the automation device comprising:

a self-aligning housing having rear-facing magnetic material in a location corresponding to the cover plate screw;

a plurality of electrically conductive male prongs extending outward from the housing and disposed in an arrangement compatible for insertion into a plurality of plug recesses of the electrical receptacle;

at least one female electrical receptacle subassembly comprising a plurality of conductive contacts disposed in recesses in an arrangement compatible with a male electrical plug;

a regulator adapted to regulate an electrical connection between at least one of the electrically conductive male prongs and at least one of the conductive contacts;

a controller configured to control the regulator in response to a signal.

22. An automation device for installation over an electrical receptacle having a cover plate secured thereto by at least one ferrous metal cover plate screw, the automation device comprising:

a self-aligning housing having rear-facing magnetic material in at least one location corresponding to the cover plate screw, and having at least one aperture extending through the housing to provide access for insertion of an electrical plug into the receptacle;

at least one sensor; and a wireless communication device for communicating from the automation device a signal encoding information derived from the at least one sensor.

* * * * *